US005537945A

United States Patent [19]

Sugihara et al.

[11] Patent Number: 5,537,945

[45] Date of Patent: Jul. 23, 1996

[54] SEWING DATA MODIFYING APPARATUS

[75] Inventors: Yoshihide Sugihara, Nagoya; Kazushi Inoue, Aichi-ken; Takashi Kondo, Obu; Jun Gamano, Okazaki; Yoshihiro Hara, Kasugai, all of Japan

[73] Assignee: Brother Kogyo Kabushiki Kaisha, Aichi-ken, Japan

[21] Appl. No.: 380,515

[22] Filed: Jan. 30, 1995

[30] Foreign Application Priority Data

Feb. 3, 1994 [JP] Japan ..... 6-011568
Jan. 17, 1995 [JP] Japan ..... 7-004843

[51] Int. Cl.[6] ..... D05B 21/00

[52] U.S. Cl. ..... 112/470.06; 112/103; 112/155; 112/475.02; 364/470.08

[58] Field of Search ..... 112/121.12, 103, 112/121.11, 262.3, 266.1, 470.06, 470.07, 475.02, 475.04, 475.05, 475.19, 102.5; 364/470

[56] References Cited

U.S. PATENT DOCUMENTS 4,655,149 4/1987 Szydlek ..... 112/121.12
4,742,786 5/1988 Hashimoto et al. ..... 112/103 X
4,763,586 8/1988 Takenoya et al. ..... 112/121.12 X
4,920,902 5/1990 Takenoya et al. ..... 112/103

FOREIGN PATENT DOCUMENTS 59-225095 12/1984 Japan .
4-89092 3/1992 Japan .
4-364888 12/1992 Japan .
6-126048 5/1994 Japan .

*Primary Examiner*—Peter Nerbun
*Attorney, Agent, or Firm*—Oliff & Berridge

[57] ABSTRACT

An apparatus for modifying sewing data to control a sewing machine including (a) a stitch-forming device for forming stitches on at least one work sheet, (b) a work-holding device for holding the work sheet, and (c) a displacing device for displacing at least one of the stitch-forming device and the work-holding device, relative to each other, according to the sewing data, the sewing machine having a prescribed coordinate system, the apparatus including a plurality of detectable objects located at a plurality of fixed positions spaced apart from each other on the work-holding device, respectively; a position detector which detects an actual position of each of the detectable objects in the prescribed coordinate system of the sewing machine; and a data modifying device for modifying the sewing data based on a difference of the detected actual position of the each of the detectable objects from a corresponding one of respective reference positions of the detectable objects in the prescribed coordinate system of the sewing machine.

21 Claims, 17 Drawing Sheets

94
96
98
102
CPU
ROM
RAM
18
FIRST DRIVE CIRCUIT
DRIVE MOTOR
116
100
110
ANGULAR-POSITION SENSOR
112
SECOND DRIVE CIRCUIT
X-AXIS PULSE MOTOR
36
THIRD DRIVE CIRCUIT
Y-AXIS PULSE MOTOR
38
114
X-AXIS-ORIGIN SENSOR
90
Y-AXIS-ORIGIN SENSOR
92
INPUT/OUTPUT PORT
FLOPPY DISK DRIVE
104
PERSONAL COMPUTER
106
SEWING MACHINE
108
SEWING MACHINE
108
OPERATOR'S BOX
118

SEWING DATA MODIFYING APPARATUS

BACKGROUND OF THE INVENTION

1. Field of the Invention

The present invention generally relates to the art of forming a number of stitches on a single work sheet, or two or more work sheets superposed on each other, by moving the work sheet(s) relative to a stitch-forming device including a sewing needle, according to sewing data, and thereby producing a desired sewing pattern consisting of the thus formed stitches. In particular, the present invention relates to the art of modifying the sewing data.

2. Related Art Statement

There is known a sewing machine having (a) a work-holding device for holding one or more work sheets, (b) a stitch-forming device including a sewing needle, for forming stitches on the work sheet(s), and (c) a displacing device for displacing the work-holding device and/or the stitch-forming device, relative to each other. The displacing device includes a drive source, such as a pulse motor, which is controllable with respect to rotation amounts, and the displacing device is controlled according to sewing data so as to operate in synchronism with the operation of the stitch-forming device.

Sewing data define the relative positions of the stitch-forming device and the work-holding device, i.e., the relative positions of the needle as part of the stitch-forming device and the work sheet(s) held by the work-holding device, in a two-dimensional coordinate system, i.e., on a coordinate plane. Generally, an orthogonal X-Y coordinate plane defined by an X axis and a Y axis perpendicular to each other (hereinafter, referred to simply as an "X-Y coordinate plane") is used, but other kinds of coordinate planes such as a polar coordinate plane may be used to form a special sewing pattern. For easier understanding, the following statement will be made on the assumption that sewing data are prepared using an X-Y coordinate plane.

The displacing device of the sewing machine is required to displace the stitch-forming device and/or the work-holding device, relative to each other, on an X-Y coordinate. Therefore, the displacing device may be (a) a device which displaces the stitch-forming device relative to the work-holding device along each of the X and Y axes of the X-Y coordinate plane; (b) a device which displaces the stitch-forming device relative to the work-holding device along one of the X and Y axes and displaces the work-holding device relative to the stitch-forming device along the other of the X and Y axes; or (c) a device which displaces the work-holding device relative to the stitch-forming device along each of the X and Y axes. Generally, the last device (c) is employed, that is, the displacing device of the sewing machine displaces the work sheet(s) held by the work-holding device, relative to the needle as part of the stitch-forming device, along each of the X and Y axes. However, it is most understandable to assume that the first device (a) is employed, that is, the displacing device of the sewing machine displaces the stitch-forming device relative to the work-holding device along each of the X and Y axes so that the needle is moved relative to the work sheet(s). Since the first and last devices (a), (c) are mathematically equivalent to each other, the following statement will be made on the assumption that a sewing needle is moved relative to a work sheet(s).

Sewing data contain, at least, stitch-position defining data defining a number of stitch positions where a sewing needle penetrates a work sheet(s) held by a work-holding device. Stitch-position defining data may be (a) sets of stitch-position data each of which directly represents the x and y coordinates of a corresponding one of the stitch positions on the X-Y coordinate plane; (b) data which indirectly represent the stitch positions, for example, data representing the respective distances of movement of the needle from each stitch position to the following stitch position along the X and Y axes; or (c) data for use as a basis for calculating the x and y coordinates of each stitch position, for example, combination of (c1) data representing an embroidery area and (c2) data representing the density of stitches to be formed in the embroidery area. In almost all cases, the stitch-position defining data additionally contain control data to move the stitch-forming device relative to the work-holding device while the needle is stopped. When the operation of the displacing device is controlled in synchronism with the operation of the stitch-forming device according to the sewing data, a group of stitches are formed, on the work sheet(s), at the respective stitch positions in accordance with the sewing data, so that a sewing product having a sewing pattern consisting of the group of stitches are obtained.

Thus, sewing data provide part of a control program which additionally includes various auxiliary data such as (a) control data to start and stop the operation, and change the rotation speed, of a drive motor as a drive source of the stitch-forming device; and (b) control data to cut a sewing thread carried by the needle, after completion of a sewing operation.

A sewing pattern formed by the sewing machine may be (a) a stitch line consisting of stitches formed on a single straight or curved line; (b) a stitch pattern consisting of stitches which are formed essentially along a single straight or curved line and at least a part of which are formed at positions away from the single line; or (c) an embroidery pattern consisting of dense or coarse stitches filling an area bounded by a closed outline.

In many cases, the work-holding device holds a plurality of work sheets superposed on each other. However, in the case where a stitch pattern or an embroidery pattern is formed, a single work sheet may be held by the work-holding device. The work sheet(s) may be a cloth sheet(s), a leather sheet(s), a soft-resin sheet(s), or other kinds of sheet(s).

When a sewing machine is controlled according to sewing data, a sewing pattern in accordance with the sewing data is formed on a work sheet(s) as described above. However, the sewing pattern may not be formed at an appropriate or accurate position on the work sheet(s). The relative position of the stitch-forming device and the work-holding device in the sewing machine contains the errors of machining of individual parts of the two devices and the errors of assembling of the two devices from their parts. Therefore, even if the work sheet(s) is(are) held accurately in position by the work-holding device, some relative-positional error will remain between the work sheet(s) and the needle of the stitch-forming device. If a sewing pattern is formed using sewing data for which the above relative-positional error has not been taken into consideration, the sewing pattern formed is located out of position from a prescribed, accurate position on the work sheet(s).

Sewing data may be produced by (a) an exclusive-use sewing-data producing device which does not have the stitch-forming function (hereinafter, referred to as the "exclusive sewing-data producing device"), or (b) a sewing machine which has the sewing-data-producing function in addition to the stitch-forming function.

In the former case (a), sewing data may be produced by (a1) drawing, on a display of a data processing device such as a personal computer, a figure corresponding to a sewing pattern itself, or a straight or curved line or an embroidery area each defining a sewing pattern, and processing the drawn figure; by (a2) inputting various data into a data processing device through a data input device such as a keyboard and processing the input data; or (a3) reading the relative positions of a paper pattern corresponding to a work sheet(s), relative to a pointer corresponding to a sewing needle, and processing the read relative-position data. Meanwhile, in the latter case (b), sewing data may be obtained by having a work sheet(s), or a pattern sheet corresponding to the work sheet(s), held by a work-holding device of the sewing machine and reading the relative positions of the work sheet(s) or pattern paper relative to a sewing needle as a pointer of the sewing machine. To this end, an operator has the work sheet(s) or paper pattern held accurately in position on a sewing frame of the work-holding device. Thus, the sewing data produced on (b) the sewing machine are adapted to the actual position of the sewing frame thus serving as a work-positioning reference member.

Hereinafter, first, there will be explained the first case (a) where sewing data are produced using an exclusive sewing-data producing device. In this case, normally, sewing data are prepared using a theoretical X-Y coordinate plane which a sewing machine is designed to have.

However, the sewing machine has, in addition to the above theoretical X-Y coordinate plane, an actual X-Y coordinate plane defined by the actual relative position of a stitch-forming device and a displacing device thereof.

The displacing device of the sewing machine includes (1) an X-axis displacing device for displacing the stitch-forming device in a positive and a negative direction along a first axis corresponding to the X axis of the theoretical X-Y coordinate plane, and (2) a Y-axis displacing device for displacing the stitch-forming device in a positive and a negative direction along a second axis corresponding to the Y axis of the theoretical X-Y coordinate plane. It is not essential but very convenient to regard, as the origin of the actual X-Y coordinate plane, the position of the needle at the time when the needle is positioned at the respective origins of the first and second axes, respectively.

However, in almost all cases, the respective origins of the first and second axes of the X-axis and Y-axis displacing devices are located more or less out of position from the origin of the theoretical X-Y coordinate plane, because of the cumulative errors of machining and assembling of the individual parts of the X-axis and Y-axis displacing devices and the stitch-forming device. For the same reason, the first and second axes of the X-axis and Y-axis displacing devices are slanted more or less from, i.e., are not parallel to, the X and Y axes of the theoretical X-Y coordinate plane, respectively. Consequently, the actual X-Y coordinate plane is translated from, and rotated from, the theoretical X-Y coordinate plane.

Fortunately, even in the case where sewing data are prepared using the theoretical X-Y coordinate plane, the sewing data can be used on the actual X-Y coordinate plane of the sewing machine, as if there were no translation or no rotation of the actual X-Y coordinate plane from the theoretical X-Y coordinate plane. Therefore, it can be said that there is no translation or no rotation of the actual X-Y coordinate plane from the theoretical X-Y coordinate plane.

However, there may remain some amount of translation and/or some amount of rotation of the work-holding device with respect to the actual X-Y coordinate plane, i.e., or the displacing device defining the actual X-Y coordinate plane, for the same reason as explained above. Since a work sheet(s) is(are) held accurately in position on the work-holding device by using a work-positioning reference member such as a sewing frame of the work-holding device, the relative-positional error of the work-holding device with respect to the displacing device directly results in forming a sewing pattern more or less out of position on the work sheet(s).

Next, there will be explained the second case (b) where sewing data are produced by a sewing machine. In this case, as previously described, the sewing data produced are adapted to the actual position of the work-positioning reference member of the work-holding device. Therefore, by adjusting (1) the actual position of the work-positioning reference member relative to the work-holding device and/or (2) the actual position of the work-holding device relative to the displacing device, the relative-positional error of the work-positioning reference member relative to the displacing device can be eliminated in advance before sewing data are produced. The thus adjusted sewing machine enables sewing data to be prepared using the actual X-Y coordinate plane of the sewing machine. The sewing data thus prepared on the sewing machine using the actual X-Y coordinate plane thereof are equivalent to the sewing data produced by the exclusive sewing-data producing device using the theoretical X-Y coordinate plane, so that the former sewing data can be used in place of the latter sewing data without needing any modification.

On the other hand, in the case where the actual position of the work-holding device is not adjusted in advance before sewing data are produced, the sewing data produced are adapted to the work-positioning reference member located out of position relative to the actual X-Y coordinate plane of the sewing machine. Thus, the sewing data contain a relative-positional error with respect to the actual X-Y coordinate plane of the sewing machine. Therefore, if the sewing data are used on another sewing machine, a sewing pattern is formed, on the work sheet(s), out of position by an amount corresponding to the difference of (1) the relative-positional error of the first sewing machine on which the sewing data are produced and (2) that of the second sewing machine on which the sewing data are used.

For the reasons explained above in detail, a sewing pattern formed by a sewing machine using the sewing data produced by the exclusive sewing-data producing device, may not be located at an appropriate or accurate position on a work sheet(s).

In contrast, when a sewing pattern is formed by a sewing machine using the sewing data produced by the same sewing machine, no problem arises. However, when the sewing data are used on another sewing machine, the same problem arises.

In some cases, the problem that a sewing pattern is not formed at an accurate position on a work sheet(s) does not provide any adverse effect. However, for example, in the case where a sewing pattern is formed for attaching a pocket to a garment or in the case where a stitch line or a stitch pattern is formed along the edges of a work sheet(s), the above problem results in greatly lowering the quality of a sewing product. This problem is exaggerated in the particular case where an elongate sewing pattern is formed, e.g., along the longitudinal edges of a belt.

Meanwhile, the production of a number of identical sewing products in a short period of time may be carried out by concurrently operating a plurality of sewing machines belonging to a sewing system. In this method, the sewing data produced by an exclusive sewing-data producing device may be input into each of the sewing machines, or the sewing data produced by using one of the sewing machines may be input into each of the other sewing machines. In either case, however, the sewing products produced by the different sewing machines suffer from the problem that the sewing patterns are formed at different positions on the different products.

If each of the sewing machines is designated to produce sewing data exclusive therefor and the produced sewing data are used on that sewing machine only, no problem arises. In this case, however, it is required to produce the same number of batches of sewing data as the number of the sewing machines, and the production efficiency of the sewing products is greatly lowered.

SUMMARY OF THE INVENTION

It is therefore an object of the present invention to provide an apparatus for modifying sewing data not adapted to the relative-positional error of a work-holding device and a displacing device of a sewing machine, into modified sewing data adapted to the error.

The above object has been achieved by the present invention. According to a first aspect of the present invention, there is provided an apparatus for modifying sewing data to control a sewing machine including (a) a stitch-forming device for forming stitches on at least one work sheet, (b) a work-holding device for holding the work sheet, and (c) a displacing device for displacing at least one of the stitch-forming device and the work-holding device, relative to each other, according to the sewing data, the sewing machine having a prescribed coordinate system, the apparatus comprising a plurality of detectable objects located at a plurality of fixed positions spaced apart from each other on the work-holding device, respectively; a position detector which detects an actual position of each of the detectable objects in the prescribed coordinate system of the sewing machine; and data modifying means for modifying the sewing data based on a difference of the detected actual position of the each of the detectable objects from a corresponding one of respective reference positions of the detectable objects in the prescribed coordinate system of the sewing machine.

In the sewing-data modifying apparatus constructed as described above, the plurality of detectable objects are located at the plurality of fixed positions spaced apart from each other on the work-holding device. Each of the detectable objects is only required to permit the position detector to detect or identify the actual position thereof, i.e., one specific point in the prescribed coordinate system of the sewing machine. In the case where the prescribed coordinate system is an orthogonal X-Y coordinate plane, each detectable object is required to permit the identification of the x and y coordinates thereof on the X-Y coordinate plane. The detectable objects may be provided on the work-holding device, either permanently or only when necessary. In the former case, the detectable objects may be fixed to a part or member of the work-holding device, or otherwise may be made movable between an operative position and a retracted position. In the case of permanently fixing the detectable objects, the objects enjoy a simple construction. However, if the sewing needle is used as a pointer for detecting the objects, it is required to fix the objects in an area within which the needle can be moved, and the needle can possibly be interfered with by the objects while the needle is moved to form a sewing pattern. For solving this problem, it is desirable to take the countermeasure of employing a control program to use, for the position-detecting operation and the stitch-forming operation, different ranges in each of which the needle and the work-holding device are permitted to move relative to each other. In the case of employing the movable detectable objects, the objects suffer from a somewhat complex construction but are free from the problem that the objects may interfere with the movements of the needle. In the latter case where the detectable objects are provided only when necessary on the work-holding device, the objects themselves or a member having the objects are detachably attached to a part or member of the work-holding device. In this manner, the objects suffer from a somewhat complex construction, but are effectively prevented from interfering with the movements of the needle in the stitch-forming operation. At least two detectable objects provided at fixed positions spaced apart from each other ensure that the error of positioning of the work-holding device with respect to the actual coordinate plane of the sewing machine as the prescribed coordinate system of the same. However, three or more detectable objects may be employed. In the latter case, it is possible to adapt the position detector to select appropriate two objects out of the three objects, depending upon the shape and dimensions of the work sheet(s), and detect the respective actual positions of the selected two objects. Otherwise, it is possible to detect the respective actual positions of all the three or more objects, statistically analyze the obtained results, and determine the amount of translation and amount of rotation of the work-holding device with respect to the prescribed coordinate system of the sewing machine. In either case, the position detector detects the actual position of each of the detectable objects in the prescribed coordinate system of the sewing machine, and the data modifying means modifies the sewing data based on the detected actual positions of the detectable objects. This sewing-data modification is carried out to eliminate the amount of translation and amount of rotation of a sewing pattern formed according to the sewing data not modified, from an accurate position where the sewing pattern should properly be formed on the work sheet(s), i.e., eliminate the amount of translation and amount of rotation of the work-holding device with respect to the theoretical or actual coordinate plane of the sewing machine as the prescribed coordinate system of the same. When a drive source of the displacing device is controlled according to the modified sewing data, the stitch-forming device forms stitches at the respective stitch positions adapted to the actual position of the work-holding device of the sewing machine. Thus, a sewing pattern is formed at the accurate position on the work sheet(s). The present sewing-data modifying apparatus modifies the sewing data not adapted to a sewing machine, into modified sewing data adapted to the sewing machine. Even in the case where the sewing data which are not produced or modified on a sewing machine are used on that sewing machine, the present apparatus ensures that the sewing machine forms a sewing pattern at an accurate position on a work sheet(s). This advantage is found in the case where a single sewing machine uses sewing data produced by an exclusive sewing-data producing device or standard sewing data commercially available on the market, and more significantly in the particular case where a sewing system including a plurality of sewing machines uses sewing data for producing a lot of identical sewing products.

In a preferred embodiment in accordance with the first aspect of the invention, the work-holding device comprises a sewing frame for holding the work sheet, a frame holder for holding the sewing frame, and a positioning device for securely positioning the sewing frame relative to the frame holder, and the detectable objects comprise a plurality of position-detectable portions of a jig member, the jig member being securely positionable relative to the frame holder in place of the sewing frame by the positioning device so that the jig member is held by the frame holder. In this embodiment, when the sewing data is modified, the jig member is held in place of the sewing frame by the frame holder. Since each of the sewing frame and the jig member is positionable relative to the frame holder by the common positioning device, the sewing data are modified based on the detected actual positions of the detectable objects provided as the detectable portions of the jig member, as if the sewing data were modified based on the detected actual position of the sewing frame. Otherwise, it is possible to provide the detectable objects on the sewing frame itself, so that the sewing frame also functions as a position-detectable jig member. However, since, in many cases, various sorts of sewing frames corresponding to various sorts of sewing products are used, it is rather advantageous to use an exclusive-use position-detectable jig member than to provide the detectable objects on every sort of sewing frame. This advantage becomes more significant as the sorts of the sewing products increase. When the single position-detectable jig member is used in place of the various sorts of sewing frames, the detection of the actual positions of the detectable objects can be performed at a low cost. In the particular case where the present invention is applied to a sewing system including a plurality of sewing machines, only a smaller number (e.g., one) of jig members than the number of the sewing machines are needed for all the sewing machines. Thus, the present apparatus enjoys a still lower cost.

In another embodiment in accordance with the first aspect of the invention, the apparatus further comprises an input device which is operable for inputting, into the apparatus, a plurality of sets of reference position data each of which is representative of a corresponding one of the reference positions of the detectable objects. In this embodiment, sewing data produced by utilizing a first sewing machine are advantageously used on a second sewing machine. The input sets of reference position data are compared with sets of actual-position data representative of the detected actual positions of the detectable objects, respectively. In the case where sewing data are prepared on the theoretical X-Y coordinate plane, the sets of reference-position data of the detectable objects can be prepared on the same plane. It is therefore possible to store, in advance, the sets of reference-position data in, e.g., a ROM of a control device of the second sewing machine when the sewing machine is manufactured. In this case, it is not necessary to input the reference-position data. On the other hand, in the case where sewing data produced, or modified, on a first sewing machine, are used on a second sewing machine, sets of reference-position data for the detectable objects of the second sewing machine should be prepared on the actual X-Y coordinate plane of the first sewing machine. The input device is used to input the thus prepared reference-position data. The reference-position data may be input together with, or independently of, the sewing data. In the latter data-input manner, the input device for inputting the reference-position data may be different from that for inputting the sewing data. The input device for inputting the sewing data may comprise a floppy disk drive for reading in the data stored in a floppy disk, whereas the input device for inputting the reference-position data may comprise a keyboard. In the case where sewing data produced or modified on a first sewing machine are used on a second sewing machine, a sewing pattern is formed at an accurate position on a work sheet(s) according to the sewing data modified based on the reference-position data input through the input device.

According to a feature of the present invention, the jig member comprises a sewing-frame model having substantially same shape and dimensions as those of the sewing frame. The jig member is required to have the position-detectable portions thereof located at the fixed positions spaced apart from each other, but is not required to have substantially the same shape and dimensions as those of the sewing frame. However, in the case where the jig member has substantially the same shape and dimensions as those of the sewing frame, the jig member can conveniently be dealt with like the sewing frame. In this case, the sewing frame may comprise a work-holding plate having an opening formed through a thickness thereof, the opening having a shape conforming to, and surrounding, a sewing pattern consisting of stitches to be formed on the work sheet(s) by the stitch-forming device, and the sewing-frame model comprises a detectable plate having substantially same shape and dimensions as those of the work-holding plate and including, the detectable objects, a plurality of position-detectable portions which are located at a plurality of fixed positions spaced apart from each other, respectively, and on which a plurality of detectable marks are provided, respectively. While the sewing-frame model may be formed of an opaque material such as metal, it is more convenient to form the model of a transparent material such as acrylic resin, because the operator can see the situation under the transparent model. It is desirable to provide, on the sewing-frame model, a permission-range mark indicating a permission range within which the model and the needle are permitted to move relative to each other, and provide the detectable marks on the outline of the permission-range mark. In the particular case where the outline of the permission-range mark is a rectangle, it is desirable to provide at least two detectable marks at at least two vertices of the rectangle, respectively, because the amount of rotation of the work-holding device (e.g., sewing frame) with respect to the theoretical X-Y coordinate plane can be measured more accurately as the distance between the detectable marks increases.

In another embodiment in accordance with the first aspect of the present invention, the data modifying means comprises means for omitting the modification of the sewing data when an amount of the difference of the detected actual position of the each detectable object from the corresponding reference position thereof is smaller than a threshold value. In the case where sewing data produced, or modified, on a sewing machine are used by the same sewing machine to form a sewing pattern, it is not necessary to modify the sewing data. The data modifying means the function of judging whether the amount of difference of the detected actual position of the each detectable object from the corresponding reference position thereof is smaller than a threshold value and, if a positive judgment is made, omits the modification of the sewing data, i.e., does not modify the sewing data.

In yet another embodiment in accordance with the first aspect of the present invention, the each detectable object has a specific physical property different from that of surroundings thereof, and wherein the position detector comprises a detector head which detects the specific physical property, a displacing device which automatically displaces at least one of the detector head and the detectable objects, relative to each other, and a position-data obtaining device which automatically obtains position data representative of the actual position of the each detectable object detected by the detector head. Since the detection of the detectable objects is automatically carried out, the burden to the operator is reduced as such.

It is a second object of the present invention to provide a sewing system including a plurality of sewing machines at least one of which modifies sewing data not adapted to the relative-positional error of a work-holding device and a displacing device thereof, into modified sewing data adapted to the error.

The above object has been achieved by the present invention. According to a second aspect of the present invention, there is provided a sewing system comprising a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, the each sewing machine having a prescribed coordinate system, at least one of the sewing machines including a plurality of detectable objects located at a plurality of fixed positions spaced apart from each other on the work-holding device thereof, respectively, a position detector which detects an actual position of each of the detectable objects in the prescribed coordinate system thereof, and data modifying means for modifying the sewing data therefor based on a difference of the detected actual position of the each of the detectable objects from a corresponding one of respective reference positions of the detectable objects in the prescribed coordinate system thereof. In the present sewing system, sewing data may be produced by using any one of a predetermined number ("M") of sewing machines out of all ("N") the sewing machines of the sewing system, so that the sewing data produced may be input into, and used by, the sewing machines other than the M sewing machines. Each of the M sewing machines may be adjusted such that the work-positioning reference member, such as a sewing frame, of the each sewing machine is located accurately at, or inaccurately by only a negligibly small amount from, a reference position thereof in the prescribed coordinate system of the each sewing machine. This adjustment may be carried out by re-positioning the work-positioning reference member relative to the other members of the work-holding devices, and/or by re-positioning the work-holding device relative to the displacing device. The M sewing machines need not detect the actual positions of detectable objects. This is true also in the case where a predetermined number ("M") of sewing machines each having a remarkably small positional error is or are just selected from all ("N") the sewing machines of the sewing system. Only the (N-M) sewing machines other than the M sewing machines are required to have the detectable objects, the position detector, and the data modifying means. The rational number M may be one, in particular in the case where the total number N of the sewing machines belonging to the sewing system is small. On the other hand, in the case where the total number N is great, it is preferred that the number M be more than two, so that any of the two or more M sewing machines may be used to produce sewing data. In the latter case, the ease of use of the sewing system as a whole is improved. However, it is not essential that the M sewing machines be adjusted so that the error of positioning of the work-positioning reference member of each sewing machine is reduced to just a negligibly small amount. In the latter case, each of the M sewing machines is required to have the detectable objects and the position detector, but not necessarily required to have the data modifying means. In the particular case where the number M is equal to the number N, sewing data may be produced and modified on each of the sewing machines of the sewing system, and all the sewing machines may have an identical hardware and software construction.

According to a third aspect of the present invention, there is provided a sewing system comprising a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, the each sewing machine having a prescribed coordinate system; and a data producing device which has a first coordinate system and produces sewing data including a plurality of sets of position data representative of a plurality of positions in the first coordinate system, the each sewing machine including a data obtaining device which obtains the sewing data produced by the data producing device, a plurality of detectable objects located at a plurality of fixed positions spaced apart from each other on the work-holding device thereof, respectively, a position detector which detects an actual position of each of the detectable objects in the prescribed coordinate system thereof as a second coordinate system, and data modifying means for modifying the obtained sewing data based on a difference of the detected actual position of the each of the detectable objects from a corresponding one of respective reference positions of the detectable objects in the second coordinate system.

It is a third object of the present invention to provide a process of producing lots of identical sewing products by using a plurality of sewing machines, wherein, for at least one of the sewing machines, sewing data not adapted to the relative-positional error of a work-holding device and a displacing device thereof, are modified into modified sewing data adapted to the error.

The above object has been achieved by the present invention. According to a fourth aspect of the present invention, there is provided a process of producing a number of identical sewing products by using a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, the each sewing machine having a prescribed coordinate system, the process comprising the steps of: producing, using a first sewing machine out of the sewing machines, the sewing data to control the first sewing machine to form a sewing pattern on the work sheet held by the work-holding device of the first sewing machine, detecting an actual position of each of a plurality of detectable portions located at a plurality of fixed positions spaced apart from each other on the work-holding device of the first sewing machine, respectively, in the prescribed coordinate system of the first sewing machine, inputting the produced sewing data into at least one second sewing machine out of the sewing machines, the second sewing machine being different from the first sewing machine, detecting an actual position of each of a plurality of detectable objects located at a plurality of positions spaced apart from each other on the work-holding device of the second sewing machine, respectively, in the prescribed coordinate system of the second sewing machine, and modifying the input sewing data based on a difference of the detected actual position of the each of the detectable objects of the second sewing machine from the detected actual position of a corresponding one of the detectable objects of the first sewing machine.

This process is suitable for producing lots of identical sewing products, by using a plurality of sewing machines which have both the sewing function and the data-producing function. However, not all the sewing machines are required to have the data-production function, but at least one of the sewing machines is required to have that function. Each of the sewing machines may be such that the work-positioning reference member, such as a sewing frame, of the each sewing machine is located out of position from a reference position thereof in the prescribed coordinate system (e.g., on the actual X-Y coordinate plane) of the each sewing machine.

According to a fifth aspect of the present invention, there is provided a process of producing a number of identical sewing products by using a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, the each sewing machine having a prescribed coordinate system, the process comprising the steps of: adjusting the work-holding device of at least one first sewing machine out of the sewing machines, so that the work-holding device of the first sewing machine is located out of position by only a negligibly small amount from a reference position thereof in the prescribed coordinate system of the first sewing machine, producing, using the first sewing machine, the sewing data to control the first sewing machine to form a sewing pattern on the work sheet held by the work-holding device of the first sewing machine, inputting the produced sewing data into at least one second sewing machine out of the sewing machines, the second sewing machine being different from the first sewing machine, detecting an actual position of each of a plurality of detectable objects located at a plurality of fixed positions spaced apart from each other on the work-holding device of the second sewing machine, respectively, in the prescribed coordinate system of the second sewing machine, and modifying the input sewing data based on a difference of the detected actual position of the each of the detectable objects of the second sewing machine from a corresponding one of respective reference positions of the detectable objects in the prescribed coordinate system of the second sewing machine.

According to a sixth aspect of the present invention, there is provided a process of producing a number of identical sewing products by using a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, the each sewing machine having a prescribed coordinate system, the process comprising the steps of: inputting prepared sewing data into the each sewing machine, detecting an actual position of each of a plurality of detectable objects located at a plurality of fixed positions spaced apart from each other on the work-holding device of the each sewing machine, respectively, in the prescribed coordinate system of the each sewing machine, and modifying the input sewing data based on a difference of the detected actual position of the each of the detectable objects of the each sewing machine from a corresponding one of respective reference positions of the detectable objects in the prescribed coordinate system of the each sewing machine.

The prepared sewing data input into each sewing machine may be either sewing data produced using the theoretical X-Y coordinate plane of the each sewing machine, or sewing data producing using another sewing machine different from the each sewing machine. The theoretical X-Y coordinate plane is the plane which each sewing machine is designed to have. In the latter case where the prepared sewing data are sewing data produced using a different sewing machine, it is required to additionally input reference-position data representative of the reference positions of the detectable objects. The reference-position data may be produced using the different sewing machine.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Figure 1:
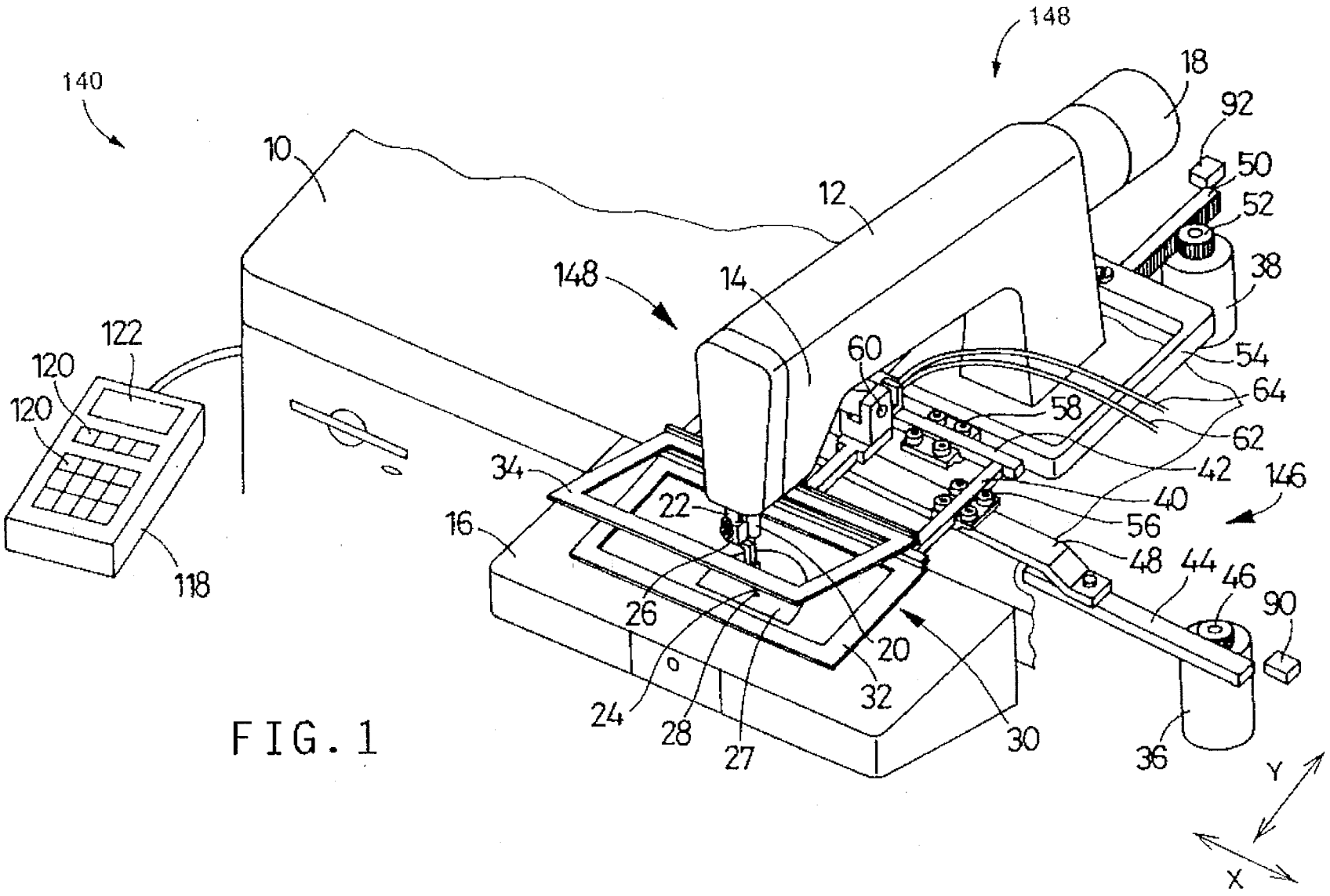
FIG. 1 is a perspective view of a pertinent part of a sewing machine including a sewing-data modifying device to which the present invention is applied.

Referring first to FIG. 1, there is shown a sewing machine 140 to which the present invention is applied. The sewing machine 140 automatically sews a work sheet, such as fabrics 170, 172 (FIG. 16), according to sewing data. The sewing machine 140 has a bed 10 and a bracket arm 12. The bracket arm 12 includes a vertical base portion extending from the upper face of the bed 10, and a horizontal arm portion whose free end extends over the front face of the bed 10. The free end of the bracket arm 12 serves as a sewing head 14 of the sewing machine 140. The sewing head 14 is positioned above a table 16 extending frontward from the front face of the bed 14.

The sewing head 14 includes a needle bar 20 which is vertically reciprocated by a drive motor 18, and a presser bar 22 which is moved upward and downward, as needed, either manually by an operator or mechanically by a known moving device. A needle 24 is attached to the lower end of the needle bar 20. A presser foot 26 is attached to the lower end of the presser bar 22. Beneath the needle bar 20 and the presser bar 22, the table 16 has a throat plate 27. The throat plate 27 has a throat or hole 28 directly below the needle 24 attached to the needle bar 20.

A fabric as a work piece or sheet to be sewn by the present sewing machine 140 (hereinafter, referred to as the "work fabric") is held by a workholder 30. The workholder 30 serves as a work-holding device. The workholder 30 includes a lower frame 32 and an upper frame 34 which cooperate with each other to hold the work fabric by sandwiching the same. The workholder 30 is displaceable in relation with the vertical reciprocation of the needle bar 20 or needle 24. More specifically, while the needle 24 held by the needle bar 20 is positioned above the work fabric held by the workholder 30, the workholder 30 is displaced by being driven by an X-axis pulse motor 36 and a Y-axis pulse motor 38.

To this end, the lower frame 32 includes a first bar 40 extending parallel to a Y axis, and a second bar 42 extending parallel to an X axis perpendicular to the Y axis. The first bar 40 is engaged via first rollers 56 with an X-axis movable member 48 which is moved in the positive and negative directions along the X axis by being driven by the X-axis pulse motor 36 via a first rack 44 and a first pinion 46. Similarly, the second bar 42 is engaged via second rollers 58 with a Y-axis movable member 54 which is moved in the positive and negative directions along the Y axis by being driven by the Y-axis pulse motor 38 via a second rack 50 and a second pinion 52.

The upper frame 34 is rotatable about an axis member 60 extending parallel to the lower frame 32. The upper frame 34 is rotated downward to, and upward from, the lower frame 32 by a known rotating device including a first and a second flexible cable 62, 64.

A work fabric can securely be held by the cooperation of the two frames 32, 34 only. However, in the case where a very accurate sewing is required, it is necessary to support the work fabric at the portions thereof adjacent to the positions where the needle 24 penetrate the fabric (hereinafter, referred to as the "stitch positions"). To this end, a work-holding plate 70, shown in FIG. 3, may be secured to the upper frame 34. The work-holding plate 70 is formed of a transparent resin. The work-holding plate 70 has an opening 72 formed through the thickness thereof. The opening 72 has a shape conforming to a sewing pattern, such as a stitch line, a stitch pattern, or an embroidery pattern, which consists of stitches to be formed on the work fabric by the sewing machine 140.

In the case where a work fabric is held by only the lower and upper frames 32, 34, it is possible to regard the upper frame 34 as a sewing frame and regard the lower frame 32 as a sewing-frame holder, or otherwise it is possible to regard the lower and upper frames 32, 34 as the sewing frame and regard the first and second bars 40, 42 as the sewing-frame holder.

In the case where the work-holding plate 70 is attached to the upper frame 34, it is possible to regard the work-holding plate 70 as the sewing frame and regard the upper frame 34 as the sewing-frame holder, or otherwise it is possible to regard the work-holding plate 70 as the sewing frame and regard the two frames 32, 34 as the sewing-frame holder.

In the following description, it is assumed that the work-holding plate 70 is secured to the upper frame 34, and the work-holding plate 70 is regarded as the sewing frame and the two frames 32, 34 are regarded as the sewing-frame holder.

Figure 2:
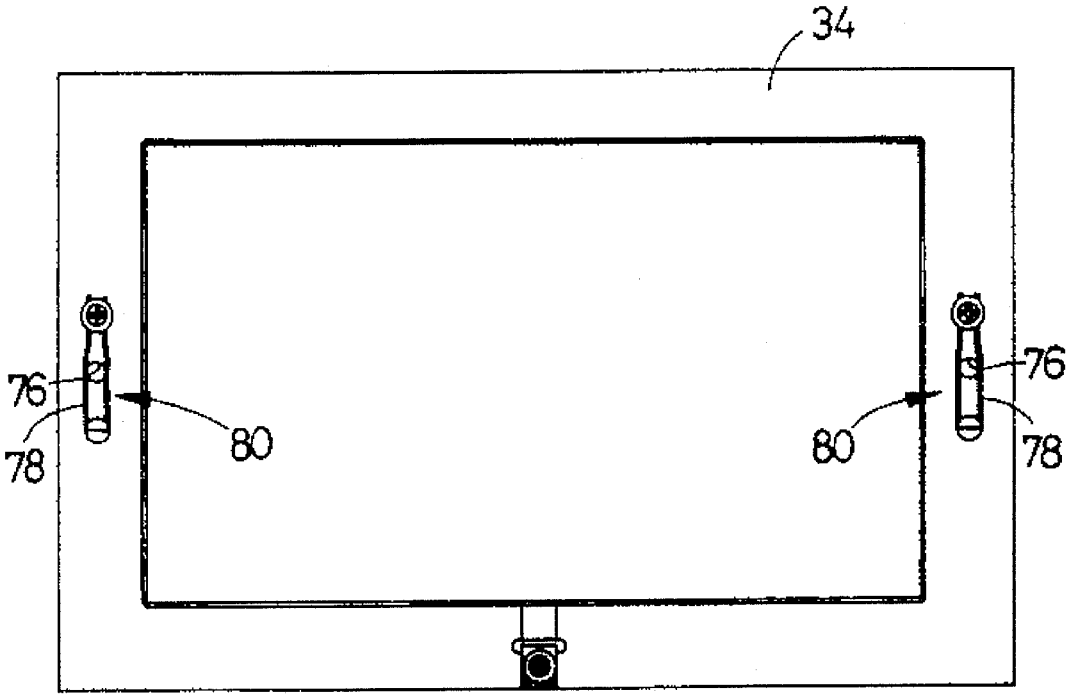
FIG. 2 is a plan view of an upper frame of a workholder of the sewing machine of FIG. 1.
Figure 3:
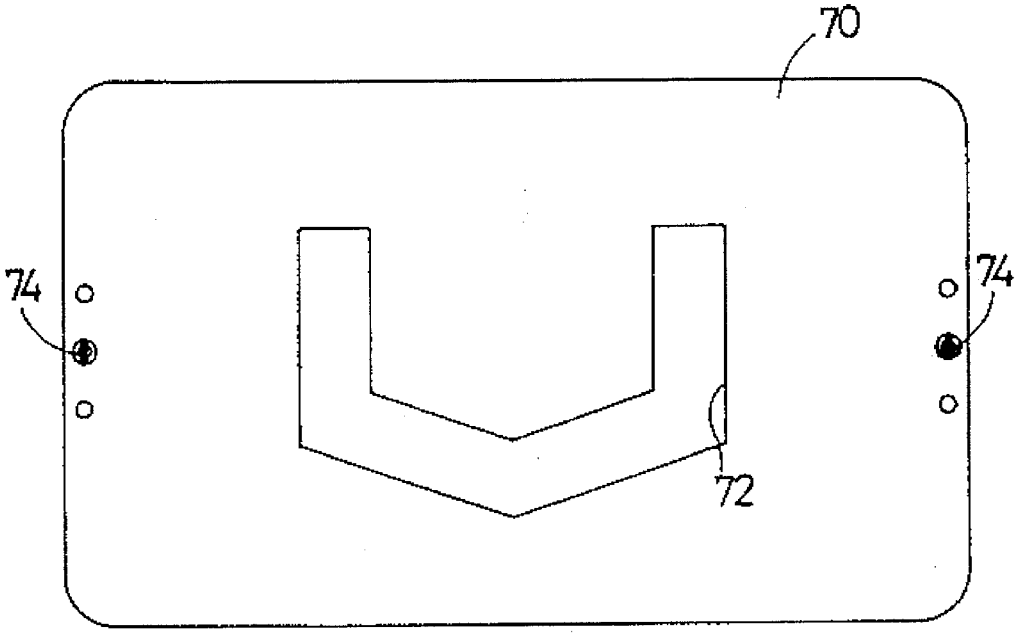
FIG. 3 is a plan view of a work-holding plate which is detachably secured to the upper frame of FIG. 2.

As shown in FIG. 3, two positioning pins 74, 74 are fixed to the work-holding plate 70, at respective positions spaced apart from each other. The upper frame 34 has two positioning holes 76, 76, as shown in FIG. 2. Each of the pins 74, 74 is just fittable in a corresponding one of the holes 76, 76. In the neighborhood of each positioning hole 76, there is provided a clamping device 80 including a wire spring 78. Each positioning pin 74 has an annular groove formed in the top end portion thereof. An operator applies the work-holding plate 70 to the lower face of the upper frame 34, in such a manner that the top end portions of the positioning pins 74, 74 pass through the corresponding positioning holes 76, 76 and that the annular grooves of the top end portions of the pins 74, 74 engage the corresponding wire springs 78, 78 being elastically deformed. Thus, the positioning pins 74, 74 are clamped by the clamping devices 80, 80. That is, the work-holding plate 70 is secured to the upper frame 34, i.e., is securely positioned relative to the lower and upper frames 32, 34 in an X-Y coordinate plane defined by the X and Y axes. The positioning pins 74, 74 and the positioning holes 76, 76 cooperate with each other to serve as a positioning device, and the clamping devices 80, 80 serve as a mounting device. However, it is possible to regard all the pins 74, holes 76 and clamps 80 as a sewing-frame mounting device having a positioning function.

The present sewing machine 140 is designed to have an X-Y coordinate plane (hereinafter, referred to as the "theoretical" X-Y coordinate plane). On the other hand, the sewing machine 140 has an "actual" X-Y coordinate plane defined by the actual X and Y axes parallel to the second and first bars 42, 40, respectively. An optical X-axis-origin sensor 90 is provided adjacent to the locus of motion of the first rack 44. Similarly, an optical Y-axis-origin sensor 92 is provided adjacent to the locus of motion of the second rack 50. The optical sensors 90, 92 may be either of a reflection type or of a transmission type. When one end of the first or second rack 44, 50 passes by the corresponding sensor 90, 92, the sensor 90, 92 changes an output signal from a first state to a second state different from the first state. The X pulse motor 36, first pinion 46, first rack 44, X movable member 48, first rollers 56, and others cooperate with each other to provide an X-axis displacing device, whereas the Y pulse motor 38, second pinion 52, second rack 50, Y movable member 54, second rollers 58, and others cooperate with each other to provide a Y-axis displacing device. Thus, the origin of the actual X axis is defined by the actual position of the X-origin sensor 90, whereas the origin of the actual Y axis is defined by the actual position of the Y-origin sensor 92. The work holder 30 (32, 34) defines an inside area, and this inside area contains a single point which is positioned directly below the needle 24 when both the two sensors 90, 92 simultaneously change the respective output signals each from the first state to the second state. This single point is the origin of the actual X-Y coordinate plane (hereinafter, referred to as the "actual" origin). Two straight lines each passing through the actual origin and extending parallel to the second and first bars 42, 40 are the actual X and Y axes (of the actual X-Y coordinate system), respectively.

The first and second bars 40, 42 are easily machinable in such a manner that the two bars 40, 42 are integrally fixed to each other with a highly accurate 90 degrees. Therefore, the actual X and Y axes enjoy a high degree of perpendicularity. The actual X-Y coordinate plane may be rotated by a small angle from the theoretical X-Y coordinate plane, and the actual origin may be translated by a small distance from the theoretical origin. However, the rotation and translation of the actual X-Y coordinate plane from the theoretical X-Y coordinate plane are negligible because sewing data can be used to control the X-axis and Y-axis displacing devices on the actual X-Y coordinate plane.

The position of any point existing in the actual X-Y coordinate plane can be defined by the respective numbers of pulses (i.e., pulse signals) supplied to the X and Y pulse motors 36, 38 for moving the workholder 30 from a state where the needle 24 is positioned above the actual origin to a state where the needle 24 is positioned above the point in question.

In the sewing machine 140, the workholder 30 is moved relative to the needle 24 fixed in position in the horizontal plane. However, it is possible to assume that the needle 24 is moved relative to the workholder 30 fixed in the horizontal plane, within the inside area defined by the workholder 30 (32, 34). Since the assumed manner is much easily understandable than the actual manner, the following description is made on this assumption.

Thus, in the present sewing machine 140, the current position of the needle 24 within the inside area of the work holder 30 is defined by the cumulative numbers of pulses supplied to the X and Y pulse motors 36, 38 to move the needle 24 from the actual origin to the current position. The cumulative pulse number for each of the X and Y pulse motors 36, 38 contains a positive or negative sign corresponding to the positive or negative direction of a corresponding one of the actual X and Y axes. The x and y coordinates of the current position of the needle 24 may be expressed in terms of a commonly used unit of length, such as millimeter (mm). Therefore, the cumulative pulse numbers for the current position may not be equal to the corresponding x and y coordinates (e.g., values in mm) for the same.

In the sewing machine 140, the control of the X and Y pulse motors 36, 38 is carried out on a pulse-number basis. On the other hand, sewing data according to which the sewing machine 140 sews a work fabric include sets of stitch-position data representative of respective stitch positions where the needle 24 penetrates the work fabric to form corresponding stitches on the fabric, and each set of stitch-position data consists of an x and a y coordinate each expressed as a value in the unit of millimeter (mm). Values in terms of millimeter units can be more easily dealt with by the operator than values in terms of pulse numbers. Therefore, the position of a certain point within the inside area of the work holder 30 may be expressed in terms of pulse numbers for some purposes, or in terms of millimeter units for other purposes, and the two sorts of values may be converted to each other, as needed. The sets of stitch-position data are one of various known sorts of stitch-position-defining data.

Figure 4:
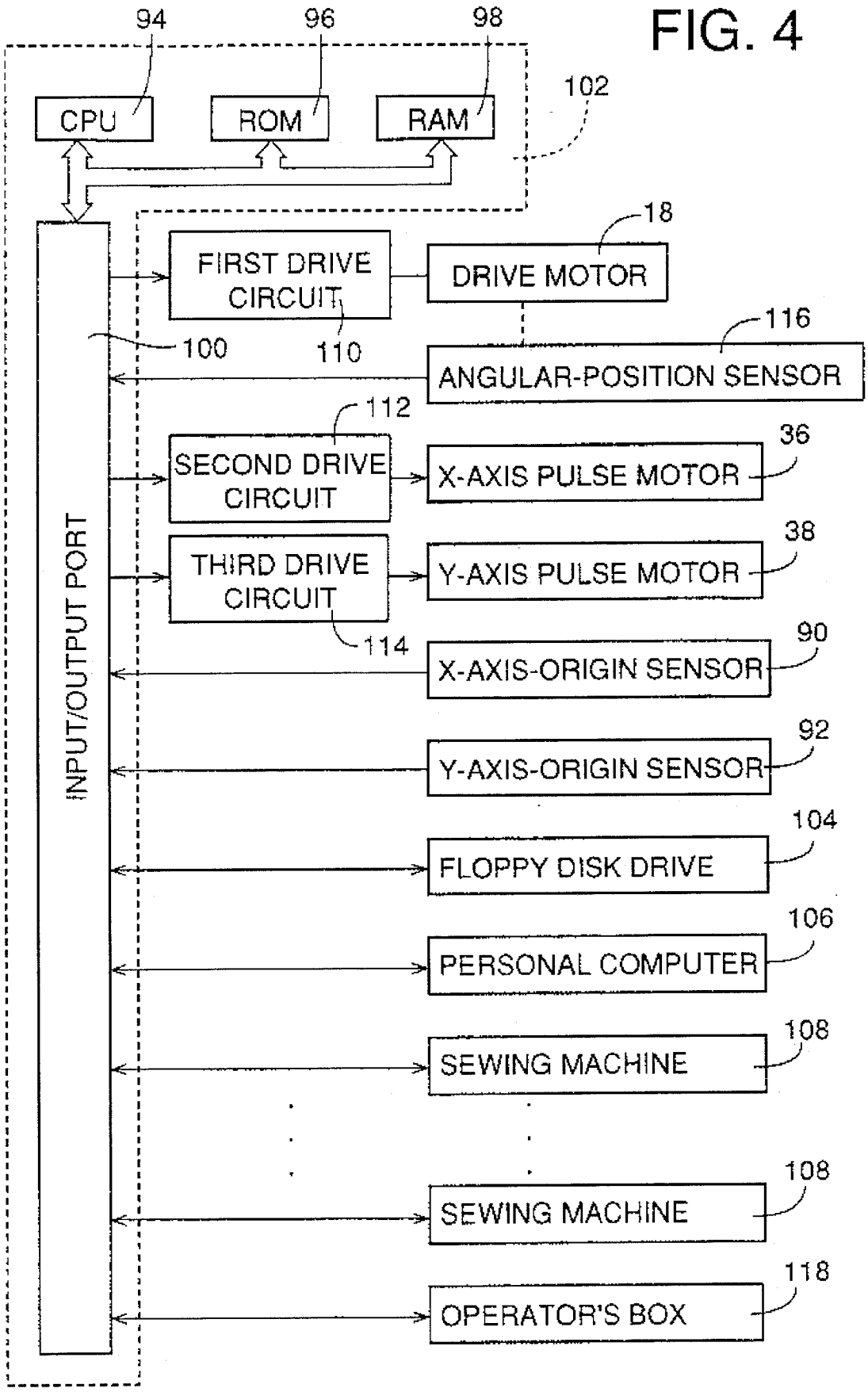
FIG. 4 is a diagrammatic view of an electric arrangement of the sewing machine of FIG. 1, the sewing machine including a control device.

Sewing data include sets of x and y coordinates for stitch positions which cooperate with each other to define a sewing pattern. The sets of x and y coordinates are arranged in the order of forming of corresponding stitches. Since the sewing data are thus given in a digitized form, the sewing data can directly be processed by a control device 102 of the sewing machine 140 shown in FIG. 4. The control device 102 includes a computer provided by a central processing unit (CPU) 94, a read only memory (ROM) 96, a random access memory 98, and an input and output (I/O) circuit 100. The control device 102 is connected to an external data-storing device such as a floppy disk drive (FDD) 104; an external data-processing device such as a personal computer 106; and other sewing machines 108, 108. The control device 102 can read original sewing data from a floppy disk (not shown) being inserted in the FDD 104 and can store modified sewing data (described in detail later) in the same or a different floppy disk (not shown) being inserted in the FDD 104. The control device 102 can exchange digital data with the personal computer 106 or each of the other sewing machines 108.

The control device 102 is connected to the drive motor 18 via a first drive circuit 110, to the X pulse motor 36 via a second drive circuit 112, and to the Y pulse motor 38 via a third drive circuit 114. Furthermore, the control device 102 is connected to an angular-position sensor 116 which detects a current angular position of a rotary element (not shown) of the drive motor 18. The current angular position of the drive motor 18 detected by the sensor 116 is utilized for moving the work holder 30 by operating the X and/or Y pulse motors 36, 38 while the needle 24 is completely drawn out of the work fabric held by the workholder 30, and also utilized for stopping the needle 24 at the upper or lower dead position of the needle 24.

The control device 102 is additionally connected to the X-origin and Y-origin sensors 90, 92 and to an operator's box 118. As shown in FIG. 1, the operator's box 118 has a number of operation keys 120 and a display 122 (e.g., liquid-crystal display). The operator's box 118 is operable by the operator for manually controlling the operation of the sewing machine 140, and also for producing sewing data by using the sewing machine 140 in a manner described later.

The ROM 96 stores the control programs represented by the flow charts shown in FIGS. 5, 6, 7, 8, and 9. The control programs are utilized for controlling the present sewing machine 140. It is however noted that the flow charts of FIGS. 5–9 represent only the pertinent portions of the actual control programs, for the purpose of simplification.

Figure 10:
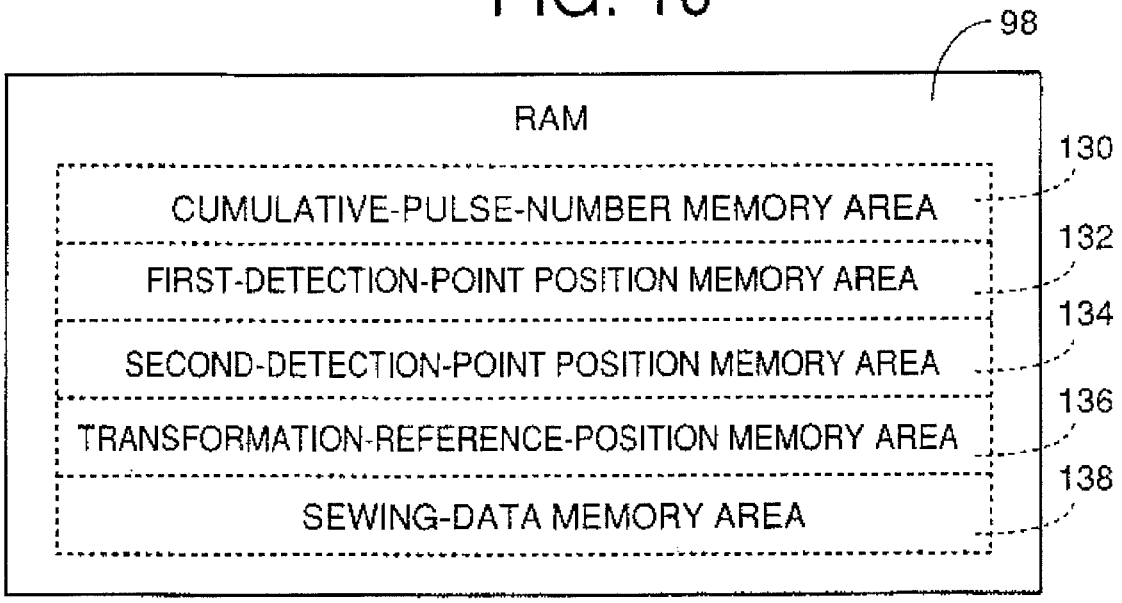
FIG. 10 is an illustrative view of various memory areas of a RAM of the control device.

As shown in FIG. 10, the RAM 98 has a cumulative-pulse-number memory area 130, a first-detection-point position memory area 132, a second-detection-point position memory area 134, a transformation-reference-position memory area 136, and a sewing-data memory area 138. The cumulative-pulse-number memory area 130 stores the respective cumulative numbers of the pulses which are supplied to the X and Y pulse motors 36, 38 after the X and Y origin sensors 90, 92 have detected the respective origins of the actual X and Y axes. When the workholder 30 is moved in the positive or negative direction along the X (or Y) axis, the cumulative pulse number for the X (or Y) pulse motor 36 (38) is increased or decreased, respectively. Thus, the cumulative pulse numbers for the X and Y pulse motors 36, 38 each have a positive or negative sign. The CPU 94 can calculate the x and y coordinates of the current position of the needle 24, based on the current cumulative pulse numbers stored in the memory area 130. The first-detection-point position memory area 132 stores data representative of an "actual" position of a first detection point 154 (FIG. 12) detected for sewing data modification described later. Similarly, the second-detection-point position memory area 134 stores data representative of an "actual" position of a second detection point 155 (FIG. 12) detected for the sewing data modification. The transformation-reference-position memory area 136 stores data representative of respective reference positions of the first and second detection points 154, 155 (hereinafter, referred to as the first and second reference positions), that is, the respective cumulative numbers of the pulses to be supplied to the X and Y pulse motors 36, 38 for moving the needle 24 from the origin of the theoretical or actual-X-Y coordinate plane to the first or second reference position in the same X-Y coordinate system. The sewing-data memory area 138 stores sewing data.

As is apparent from the foregoing description, in the present embodiment, the memory areas 130, 132, 134, 136 store position data representative of various positions given as cumulative numbers of pulses supplied to the X and Y pulse motors 36, 38, whereas the memory area 138 stores sewing data representative of stitch positions given as sets of x and y coordinates.

Thus, the control device 102 or CPU 94 deals with cumulative pulse numbers until the determination of a linear-transformation expression described later, and deals with sets of x and y coordinates in transforming sewing data according to the determined transformation expression.

Figure 11:
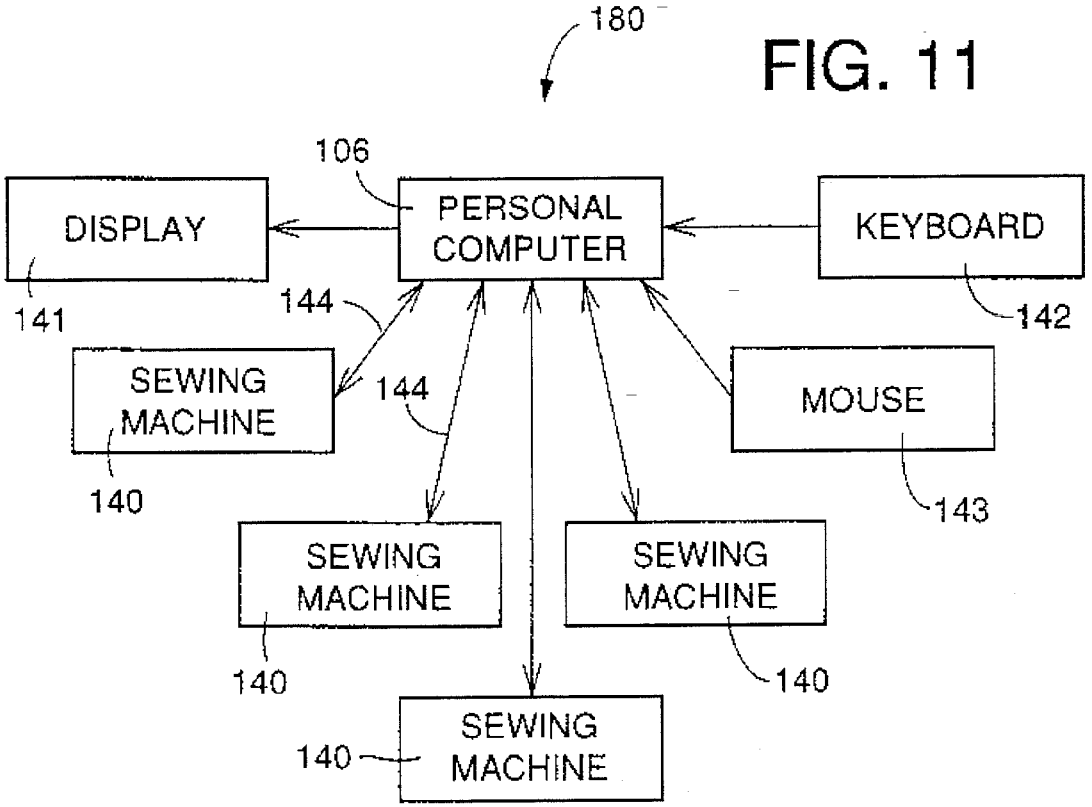
FIG. 11 is a diagrammatic view of a sewing system including a plurality of sewing machines one of which is shown in FIG. 1.

The present sewing machine 140 constructed as described above can be used solely. However, as shown in FIG. 11, it is possible to provide a sewing system 180 including a plurality of identical sewing machines 140 and one or more personal computers 106 (only one personal computer 106 is shown in FIG. 11).

The personal computer 106 is connected to a display device 141, a keyboard 142, and a mouse 143. While using the elements 141, 142, 143, the operator can operate the personal computer 106 for producing sewing data and storing the produced sewing data in a floppy disk (not shown) being inserted in an FDD (not shown) of the personal computer 106. The sewing data stored in the floppy disk can be transferred to each of the sewing machines 140. In addition, it is possible to connect the personal computer 106 to the sewing machines 140 via respective data lines 144, so that the sewing data produced by the personal computer 106 are directly supplied to each of the sewing machines 140 via the corresponding data line 144. Otherwise, the operator can operate each of the sewing machines 140 for producing sewing data. In the first case, the operator specifies, using an input device such as the keyboard 142 and/or the mouse 143, desired points, i.e., desired stitch positions in the theoretical X-Y coordinate plane displayed on the display device 141, so that the personal computer 106 produces sets of x and y coordinates corresponding to the specified stitch positions. Further, the operator inputs, through the input device 142, 143, auxiliary data including a desired stitch pitch, desired unit-pattern data representative of a unit pattern in a stitch pattern, and/or a desired stitch density. The personal computer 106 produces sewing data from the sets of x and y coordinates of the stitch positions and the auxiliary data. In the second case, the operator has a pattern, or a work fabric, held by the workholder 30 and utilizes the needle 24 as a pointer for specifying desired points along a desired stitch line, or a central straight or curved line of a desired stitch pattern, on the paper pattern or work fabric, so that a control device 102 of each sewing machine 140 produces sets of x and y coordinates corresponding to the points (i.e., stitch positions) specified on the desired stitch line, or sets of x and y coordinates corresponding to the points specified on the central line of the desired stitch pattern. Additionally, the operator inputs, through an input device (not shown) of the sewing machine 140, auxiliary data including a desired stitch pitch, desired unit-pattern data representative of a unit pattern, and/or stitch-density data. The control device 102 of the sewing machine 140 produces sewing data from the sets of x and y coordinates of the stitch positions and the auxiliary data. The sewing machines 140 may be designed to directly interchange sewing data with each other. However, in the sewing system 180, the sewing machines 140 indirectly interchange sewing data with each other via the personal computer 106.

In the case where sewing products are produced using a specified one of the sewing machines 140 belonging to the sewing system 180, the operator is only required to have one or more work fabrics held accurately in position by the workholder 30 and start a sewing operation by pushing one (i.e., "START" key) out of the operation keys 120 of the operator's box 118, for the purpose of producing a sewing product identical with the preceding one. In many cases, two pieces of work fabric are sewn to each other. However, in the case where a group of ornamental stitches such as a stitch pattern or an embroidery pattern are formed, those stitches are produced on a single piece of work fabric. The accurate positioning of the work fabrics relative to the workholder 30 can be carried out in a known manner wherein, for example, the characteristic portions of the work fabrics or the marks pre-fixed to the work fabrics are located in position relative to the opening 72 of the work-holding plate 70.

On the other hand, for the purpose of producing a sewing product different from the preceding one, and in particular for the purpose of accurately forming a sewing pattern relative to work fabrics, the operator is required to modify the sewing data before starting a sewing operation on the work fabrics held by the workholder 30.

The X and Y pulse motors 36, 38, the racks 44, 50, pinions 46, 52, the X and Y movable members 48, 54, and the X and Y origin sensors 90, 92 cooperate with one another to provide a displacing device 146 (FIG. 1) for displacing the work fabrics 170, 172 (FIG. 16) relative to the needle 24. The bracket arm 12, the drive motor 18, the needle bar 20, the needle 24, and a shuttle device (not shown) provided in the table 16 cooperate with one another to provide a stitch-forming device 148 (FIG. 1). When the respective parts of the workholder 30 serving as the work-holding device are manufactured or the workholder 30 is assembled from those parts, manufacturing errors or assembling errors inevitably occur to the sewing machine 140 as an end product. In almost cases, the sewing machine 140 has a problem that the workholder 30 is translated and/or rotated from a reference position thereof on the actual (or theoretical) X-Y coordinate system defined by the displacing device 146 and the stitch-forming device 148. Therefore, the sewing data should be modified for compensating for the translation and rotation of the workholder 30 with respect to the actual X-Y coordinate plane.

Figure 12:
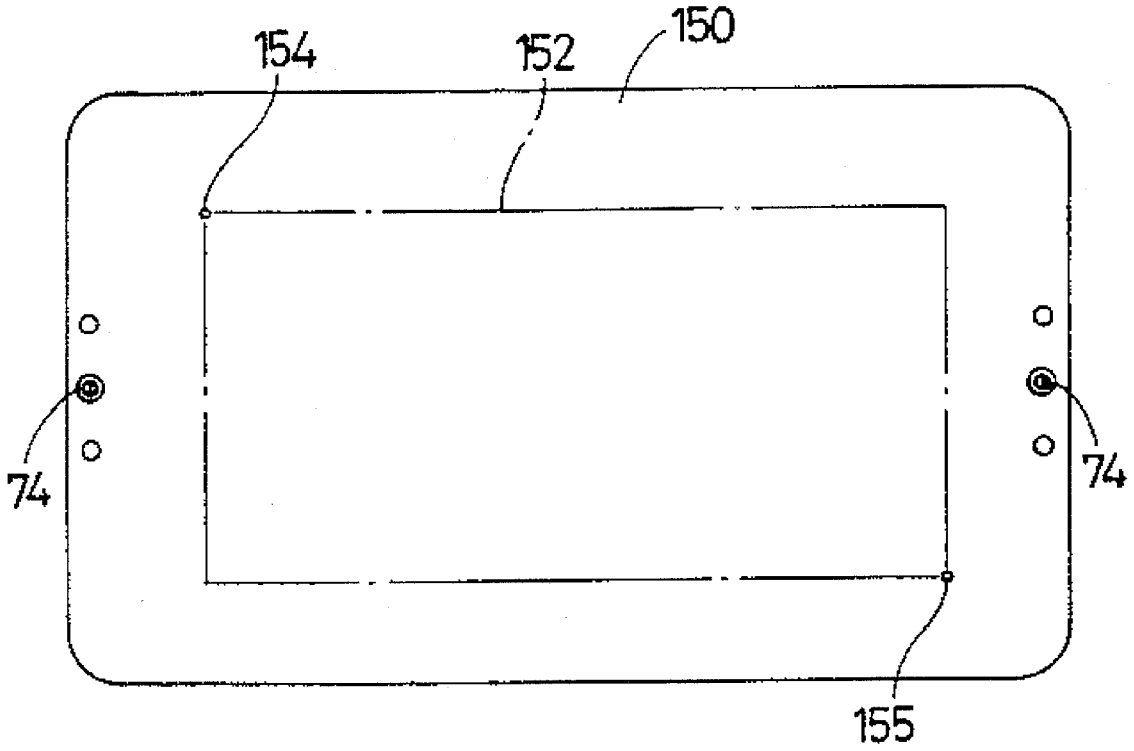
FIG. 12 is a plan view of a position-detectable jig member which is detachably secured to the workholder of the sewing machine of FIG. 1.
Figure 13:
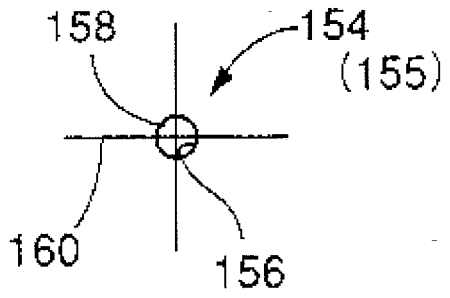
FIG. 13 is an enlarged view of a detectable mark provided on the jig member of FIG. 12.

For modifying the sewing data, a position-detectable plate 150 shown in FIG. 12 is used. The detectable plate 150 has the same shape and dimensions as those of the work-holding plate 70, and has positioning pins 74, 74 identical with those 74, 74 of the latter 70. Like the work-holding plate 70, the detectable plate 150 is detachably secured to the upper frame 34. However, the detectable plate 150 does not have an opening corresponding to that 72 of the work-holding plate 70, and has (a) a rectangular permission-range mark 152 (indicated in one-dot chain line in FIG. 12) representing a permission range within which the needle 24 is permitted to move relative to the workholder 30 and (b) a first and a second detection mark 154, 155 located at the diagonally opposite corners of the rectangular mark 152. FIG. 13 is an enlarged view of each of the two detection marks 154, 155. Each detection mark 154, 155 is provided by a through hole 156 formed through the thickness of the detectable plate 150 and filled with a soft material 158 such as a rubber. The rectangular mark 152 has two extended lines at each detection mark 154, 155, such that a portion of the rectangular mark 152 and the two extended lines provide a cross 160 whose intersection coincides with the center of the hole 156. Therefore, even if the needle 24 is brought into contact with the detection mark 154, 155, both the needle 24 and the detectable plate 150 are effectively prevented from being damaged.

With the needle 24 being stopped adjacent to the upper surface of the detectable plate 150 secured to the workholder 30, the operator operates four keys (i.e., four "STEP" keys) out of the operation keys 120 on the operator's box 118, for stepwise moving the needle 24 relative to the workholder 30 (in fact, moving the workholder 30 relative to the needle 24), so that the needle 24 is positioned directly above the center of the first detection point 154. Thereafter, when the operator pushes one (i.e., "READ" key) of the operation keys 120, the control device 102 or the CPU 94 transfers the current x and y cumulative pulse numbers which represent the current position of the needle 24 (i.e., x and y coordinates of the first detection mark 154) and which are stored in the memory area 130, to the first-detection-point position memory area 132. Similarly, after the needle 24 is moved to directly above the second detection mark 155, the READ key 120 is operated to store the x and y cumulative pulse numbers representing the x and y coordinates of the second detection mark 155, in the second-detection-point position memory area 134.

Each of the sewing machines 140 automatically modifies the sewing data based on the thus obtained x and y cumulative pulse numbers of each of the first and second detection marks 154, 155, i.e., first and second detection points. There are three sorts of sewing data to be modified by the sewing machine 140; (a) design sewing data produced by the personal computer 106, using the theoretical X-Y coordinate plane which the sewing machine 140 is designed to have; (b) modified sewing data obtained by another sewing machine 140 of the sewing system 180 by modifying the design sewing data so as to adapt the data to the actual position of the workholder 30 of the same sewing machine 140; and (c) exclusive sewing data produced by another sewing machine 140 of the sewing system 180 for exclusive use thereof by the same sewing machine 140.

However, modified sewing data obtained by a certain sewing machine 140 from design sewing data are substantially the same as exclusive sewing data produced by the same sewing machine 140. Therefore, in the following description, explanations related to exclusive sewing data also apply to modified sewing data, unless stated otherwise.

Design sewing data include, as transformation-reference-position data, x and y cumulative pulse numbers representative of a reference position of each of the first and second detection points, i.e., first and second detection marks 154, 155. Modified sewing data include, as transformation-reference-position data, x and y cumulative pulse numbers representative of the actual position of each of the first and second detection points on another sewing machine 140 which obtains the modified sewing data.

In contrast, in almost all cases, exclusive sewing data do not include transformation-reference-position data. For using, in a first sewing machine 140, the exclusive sewing data produced by a second sewing machine 140, it is required to have the position-detectable plate 150 secured to the workholder 30 of the second sewing machine 140, detect the respective actual positions of the first and second detection points (i.e., detection marks 154, 155) and produce, as the transformation-reference-position data, the x and y cumulative pulse numbers representative of the detected actual position of each of the first and second detection points. The thus produced transformation-reference-position data are added to the exclusive sewing data, in the second sewing machine 140.

In either case, before the first sewing machine 140 reads the design, modified, or exclusive sewing data from a floppy disk being inserted in the FDD 104 thereof, the design, modified, or exclusive sewing data already include the transformation-reference-position data. The first sewing machine 140 modifies the thus obtained sewing data based on (a) the transformation-reference-position data and (b) the previously-described x and y cumulative pulse numbers for each of the first and second detection points.

Figure 14:
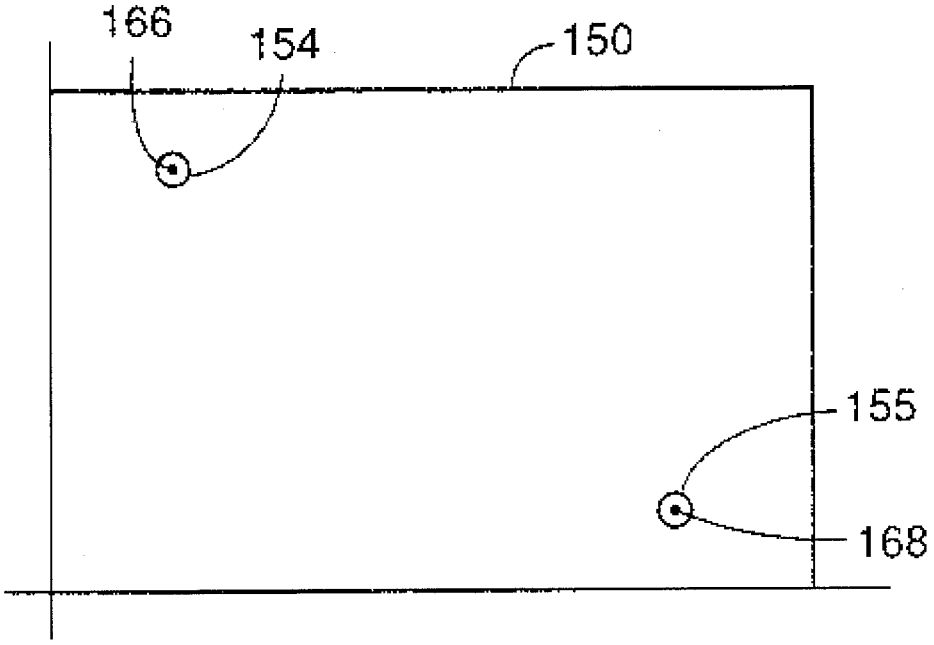
FIG. 14 is a view for illustrating the case where sewing data are not modified by the sewing machine of FIG. 1.
Figure 16:
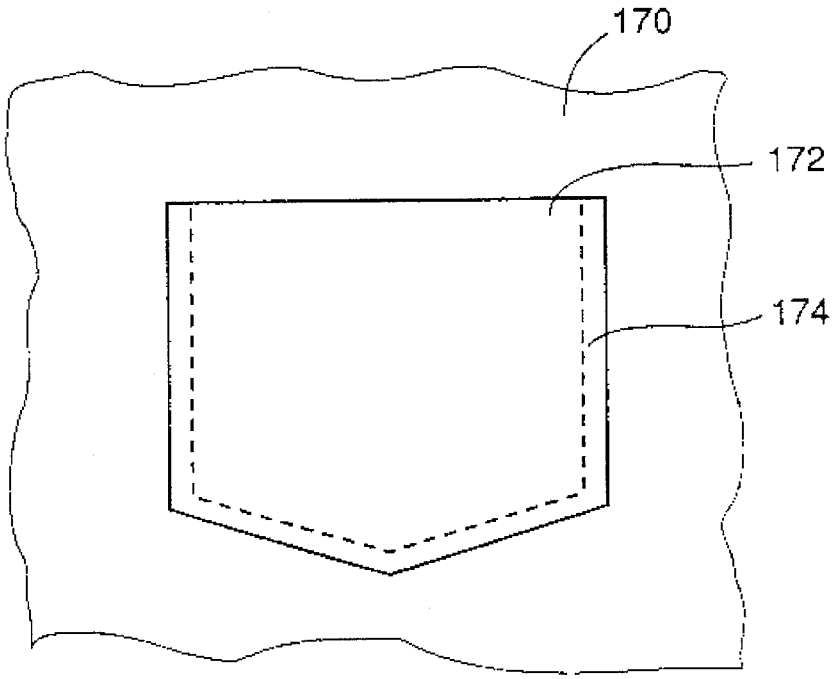
FIG. 16 is a plan view of a sewing pattern formed on work sheets by the sewing machine of FIG. 1.

First, the modification of design sewing data is described. The design sewing data are produced using the theoretical X-Y coordinate plane, and the transformation-reference-position data are given as x and y cumulative pulse numbers for the reference position of each of the first and second detection points on the theoretical X-Y coordinate plane. Supposing there is no error of positioning of the upper frame 34 and the detectable plate 150 in a sewing machine 140 on which the operator intends to use the design sewing data, the actual positions of the respective centers of the first and second detection marks 154, 155 of the detectable plate 150 coincide with respective reference positions 166, 168 of the first and second detection positions, i.e., respective design positions of the first and second detection marks 154, 155, as shown in FIG. 14. In this supposed case, the design sewing data can be used, without modification, to form a sewing pattern at an accurate position relative to the work fabrics 170, 172 (FIG. 16).

Figure 15:
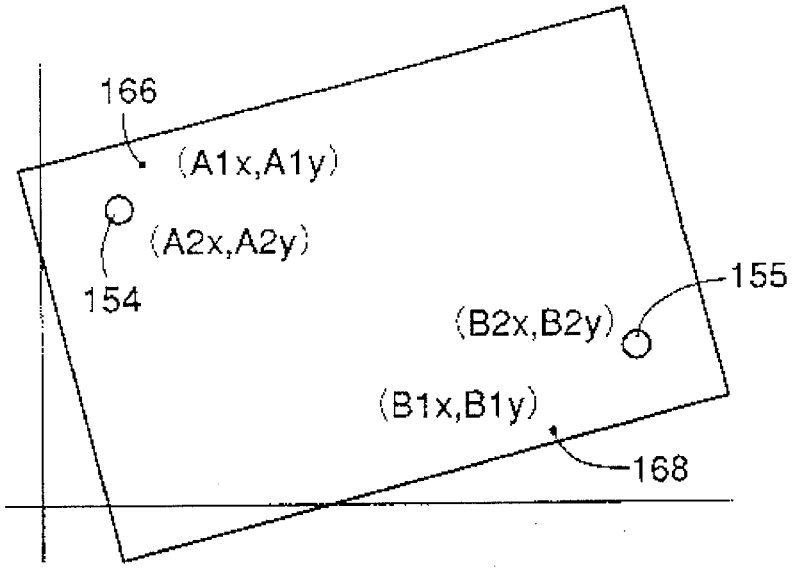
FIG. 15 is a view for illustrating the case where sewing data are modified by the sewing machine of FIG. 1.

However, generally, there is some positioning error of the upper frame 34 and the detectable plate 150 in a sewing machine 140. Therefore, as shown in FIG. 15, in almost cases, the actual positions of the respective centers of the first and second detection marks 154, 155 of the detectable plate 150 are out of position from the respective reference positions 166, 168. Thus, the work fabrics 170, 172 held in position on the workholder 30 are located out of position on the actual X-Y coordinate plane. If design sewing data are used without modification for sewing the work fabrics 170, 172, a sewing pattern is formed at an inaccurate position spaced away from an accurate or proper position by an amount of translation, and an amount of rotation, of the actual positions of the first and second detection marks 154, 155 from the reference positions 166, 168 of the same.

For solving the above problem, the design sewing data are modified by compensating for the translation amount and rotation amount of the actual positions of the first and second detection marks 154, 155 from the reference positions 166, 168 of the same. This modification is carried out by subjecting the design sewing data to linear transformation that is well known in mathematics. Provided that the reference positions 166, 168 of the first and second detection positions correspond to two sets of x and y cumulative pulse numbers, $(A_{1x}, A_{1y})$ and $(B_{1x}, B_{1y})$, respectively, and that the detected actual positions of the first and second detection positions (i.e., first and second detection marks 154, 155) correspond to two sets of x and y cumulative pulse numbers, $(A_{2x}, A_{2y})$ and $(B_{2x}, B_{2y})$, this linear transformation is given by the following four expressions:

$$A_{2x}=a\cdot A_{1x}+b\cdot A_{1y}$$

$$A_{2y}=c\cdot A_{1x}+d\cdot A_{1y}$$

$$B_{2x}=a\cdot B_{1x}+b\cdot B_{1y}$$

$$B_{2y}=c\cdot B_{1x}+d\cdot B_{1y}$$

where a, b, c, and d are transformation coefficients.

By solving the above four equations, the four coefficients a, b, c, and d are determined. By using the thus obtained coefficients a, b, c, and d, the x and y coordinates, (X, Y), of an arbitrary point on the actual X-Y coordinate plane are linear-transformed to modified x and y coordinates, (RX, RY), according to the following two expressions:

$$RX=a\cdot X+b\cdot y$$

$$RY=c\cdot X+d\cdot Y$$

Therefore, a certain sewing machine 140 modifies design sewing data by transforming, using the above two expressions, the x and y coordinates of each of the stitch positions contained in the design sewing data. The thus modified sewing data contain the sets of x and y coordinate data for the respective stitch positions ensuring that the sewing machine 140 in question forms a sewing pattern at an accurate position on the work fabrics 170, 172.

While the foregoing description relates to the modification of design sewing data, it also applies to the modification of exclusive (or modified) sewing data. However, (a) the design sewing data, and (b) the reference positions 166, 168 of the first and second detection points, for the former modification are replaced by (a') the exclusive (or modified) sewing data, and (b') the actual positions of the first and second detection points (i.e., first and second detection marks 154, 155) detected on a sewing machine 140 on which the exclusive (or modified) sewing data are produced (or obtained), respectively, for the latter data modification.

The modification of design or exclusive sewing data is automatically performed by the control device 102 of the sewing machine 140. After the modification of sewing data is completed, the operator replaces the position-detectable plate 150 with the work-holding plate 70, has the work fabrics 170, 172 held accurately in position by the workholder 30, and operates the START key 120 on the operator's box 118, so that the sewing machine 140 automatically sews the work fabrics 170, 172 according to the modified sewing data and thereby forms a prescribed sewing pattern at an accurate or proper position on the work fabrics 170, 172. The work-holding plate 70 shown in FIG. 3 is used for sewing the pocket 172 to the garment 170, as shown in FIG. 16. In this case, the sewing machine 140 forms a stitch line 174 at a small distance inward from an edge line of the pocket 172. The sewing machine 140 forms the stitch line 174 such that the small distance between the stitch line 174 and the edge line of the pocket 172 is substantially constant along the entire length of the edge line. Thus, the quality of the sewing product 170, 172 is greatly improved.

(a) The detection of the actual positions of the first and second detection points (i.e., respective centers of the two detection marks 154, 155), (b) the modification of sewing data based on the detected actual positions of the two detection points, and (c) the sewing operation using the modified sewing data, each are performed under control of the control device 102 according to the control programs represented by the flow charts of FIGS. 5 through 9.

Figure 5:
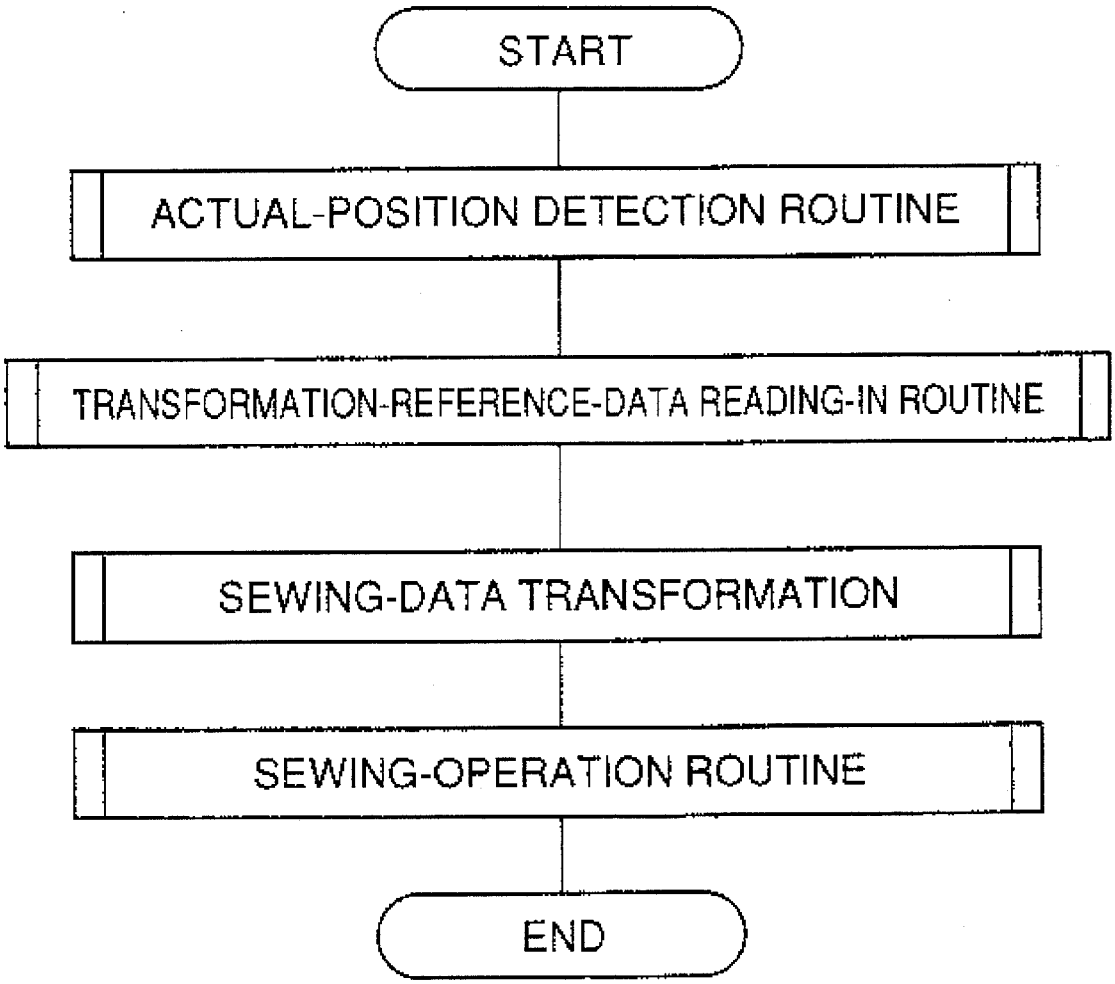
FIG. 5 is a flow chart representing control programs which are pre-stored in a ROM of the control device of FIG. 4.

As shown in FIG. 5, the control device 102 carries out the actual-position detection routine, the transformation-reference-position-data reading-in routine, the sewing-data transformation routine, and the sewing-operation routine.

Figure 6:
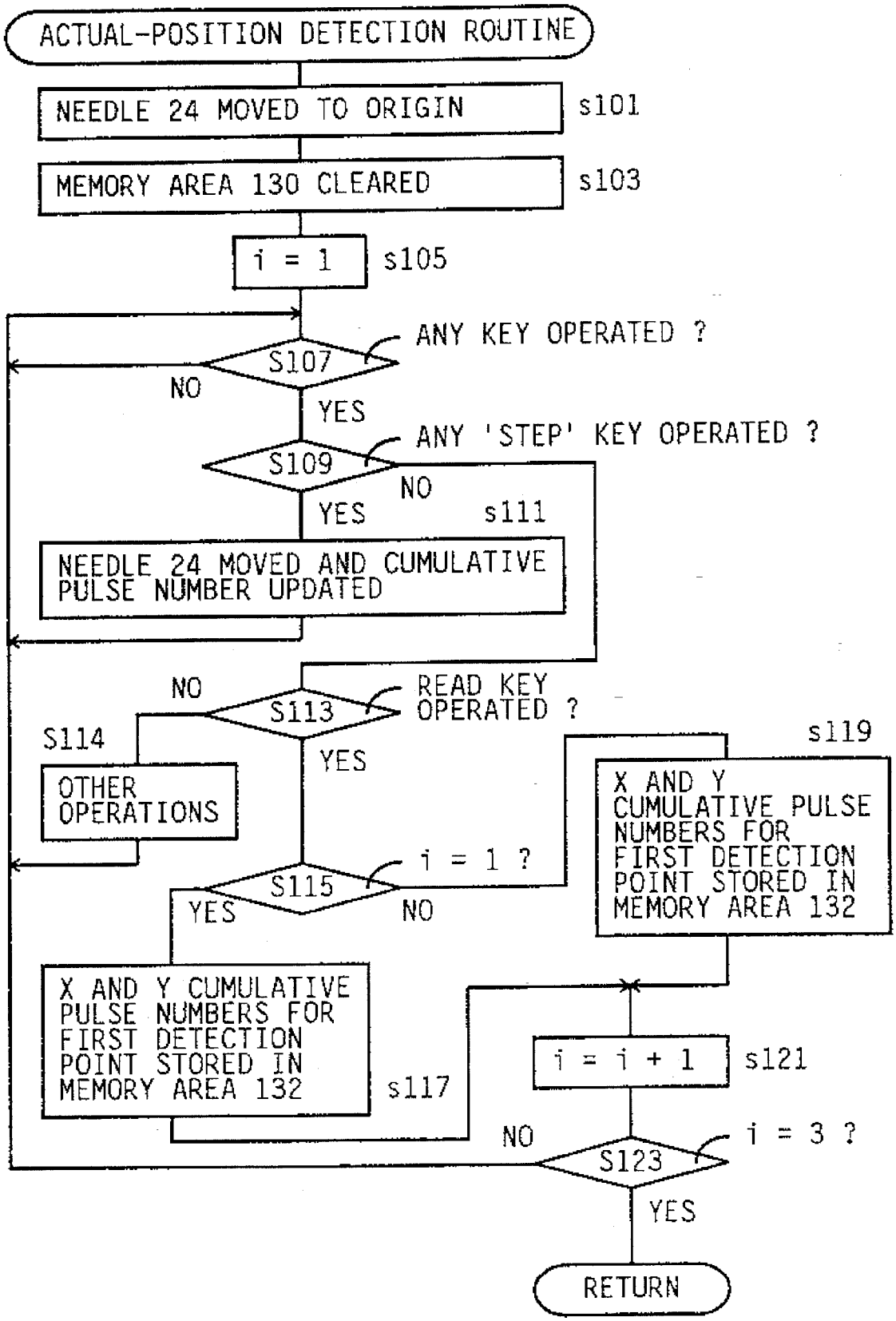
FIG. 6 is a flow chart representing an actual-position detection routine as one of the control programs.

The actual-position detection routine is represented by the flow chart of FIG. 6. Initially, at Step S101, the control device 102 or the CPU 94 of a sewing machine 140 operates for moving the needle 24 to the origin of the actual X-Y coordinate plane of the sewing machine 140. At the following Step S103, the CPU 94 clears the contents of the cumulative-pulse-number memory area 130 of the RAM 98. Specifically described, the operator operates the STEP keys 120 on the operator's box 118 for driving the X and Y pulse motors 36, 38 until the X and Y origin sensors 90, 92 detect the respective origins of the actual X and Y axes defining the actual X-Y coordinate plane of the sewing machine 140. With the needle 24 being stopped at the thus detected actual origin, the x and y cumulative pulse numbers stored in the memory area 130 each are cleared to zero. Thus, the contents of the memory area 130 indicate that the needle 24 is currently positioned at the origin of the actual X-Y coordinate plane of the sewing machine 140.

Step S103 is followed by Step S105 to set a flag, i, to i=1, and then by Step S107 to wait for operation of any key 120 on the box 118. If any key 120 is operated by the operator, the control of the CPU 94 goes to Step S109 to judge whether any of the four STEP keys 120 has been operated for moving the needle 24 relative to the workholder 30. The four STEP keys 120 correspond to the positive and negative directions along each of the X and Y axes. If any of the four STEP keys 120 is pushed for a short time, the CPU 94 operates, at Step S111, for moving the needle 24 by a distance corresponding to a single pulse supplied to the X or Y pulse motor 36, 38 and adding or subtracting one from the x or y cumulative pulse number currently stored in the memory area 130. Otherwise, if any of the four STEP keys 120 is pushed continuously for a long time, the CPU 94 operates, at Step S111, for supplying a number of pulses each of which is generated for a prescribed unit time, to the X or Y pulse motor 36, 38, moving the needle 24 by a distance corresponding to the supplied number of pulses, and adding or subtracting that pulse number from the x or y cumulative pulse number currently stored in the memory area 130. The cumulation of pulses supplied to the X pulse motor 36 (i.e., calculation of a cumulative pulse number for the X axis) is carried out independently of that for the Y pulse motor 38. When the needle 24 is moved in the positive direction, the cumulative pulse number for the X or Y axis is increased and, when the needle 24 is moved in the negative direction, the cumulative pulse number for the X or Y axis is decreased.

If a positive judgment is made at Step S107 and a negative judgment is made at Step S109, the control of the CPU 94 goes to Step S113 to judge whether the READ key 120 has been operated for reading in the current x and y cumulative pulse numbers stored in the memory area 130 (the current x and y cumulative pulse numbers represent the x and y coordinates of the current position of the needle 24 on the actual X-Y coordinate plane of the sewing machine 140). If a negative judgment is made at Step S113, the control goes to Step S114 to carry out an operation corresponding to the operated one of the operation keys 120. On the other hand, if a positive judgment is made at Step S113, the control of the CPU 94 goes to Step S115 to judge whether the flag i is set at i=1. If a positive judgment is made at Step S115, the control goes to Step S117 to read the current x and y cumulative pulse numbers stored in the memory area 130 and store the read data in the first-detection-point position memory area 132. If a negative judgment is made at Step S115, the control goes to Step S119 to transfer the current x and y cumulative pulse numbers stored in the memory area 130, to the second-detection-point position memory area 134.

Step S117 or Step S119 is followed by Step S121 to increment the flag i by one (i.e., i←i+1), and then by Step S123 to judge whether the flag i is set at i=3. In a control cycle in which the x and y cumulative pulse numbers for the first detection point are stored in the memory area 132 at Step S117, a negative judgment is made at Step S123, so that the control of the CPU 94 returns to Step S107. On the other hand, in a control cycle in which the x and y cumulative pulse numbers for the second detection point are stored in the memory area 134 at Step S119, a positive judgment is made at Step S123, so that the control of the CPU 94 quits the present, actual-position detection routine of FIG. 6 and proceeds with the transformation-reference-position-data reading-in routine of FIG. 7.

Figure 7:
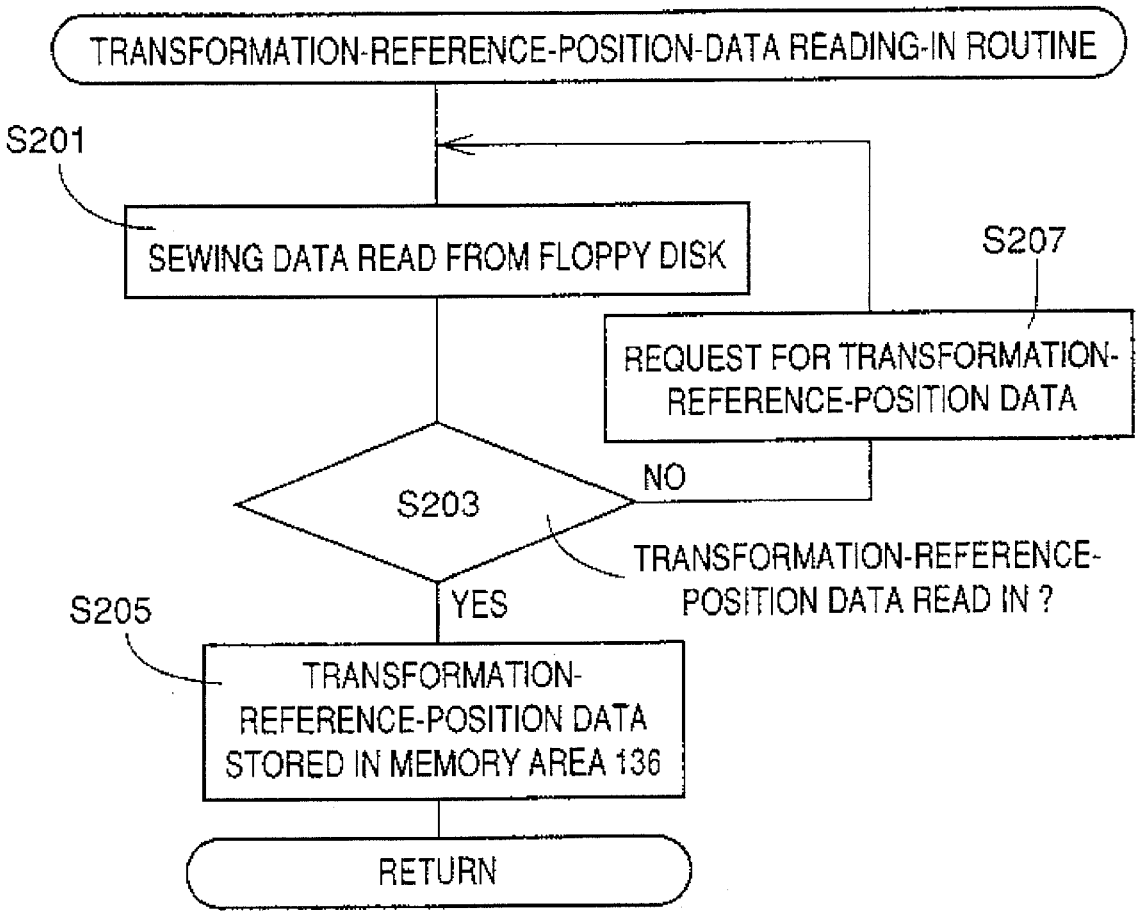
FIG. 7 is a flow chart representing a transformation-reference-position-data reading-in routine as one of the control programs.

At Step S210 of FIG. 7, the CPU 94 reads in transformation-reference-position data from an appropriate memory area of the floppy disk currently being inserted in the FDD 104.

Step S201 is followed by Step S203 to judge whether the control device 102 has read in transformation-reference-position data. In the case where sewing data contain transformation-reference-position data as previously described, the reference-position data are read together with the sewing data, so that a positive judgment is made at Step S203. In this case, the control of the CPU 94 goes to Step S205 to store the transformation-reference-position data in the transformation-reference-position memory area 136. Thus, the present control routine is ended. On the other hand, in the case where sewing data do not contain transformation-reference-position data, a negative judgment is made at Step S203, so that the control goes to Step S207 to display, on the display 122 of the operator's box 118, an indication requesting the operator to input transformation-reference-position data.

In response to the above-mentioned indication, the operator inputs transformation-reference-position data. First, the operator secures the position-detectable plate 150 to the workholder 30 of another sewing machine 140 which has been used to produce the exclusive sewing data to be used by the present sewing machine 140, and obtains the x and y cumulative pulse numbers corresponding to the actual position of each of the first and second detection points (i.e., respective centers of the two detection marks 154, 155). The obtained cumulative pulse numbers of each detection point are displayed on the display 122 of the operator's box 118 of the different sewing machine 140. The operator reads the cumulative pulse numbers and inputs the pulse numbers into the present sewing machine 140 by using the operation keys 120 of the operator's box 118 of the latter sewing machine 140. Otherwise, since the obtained cumulative pulse numbers of each detection point may be stored as transformation-reference-position data in the floppy disk of the FDD 104 of the different sewing machine 140, the operator may remove the floppy disk and insert the same into the FDD 104 of the present sewing machine 140, so that the latter sewing machine 140 reads in the transformation-reference-position data.

Figure 8:
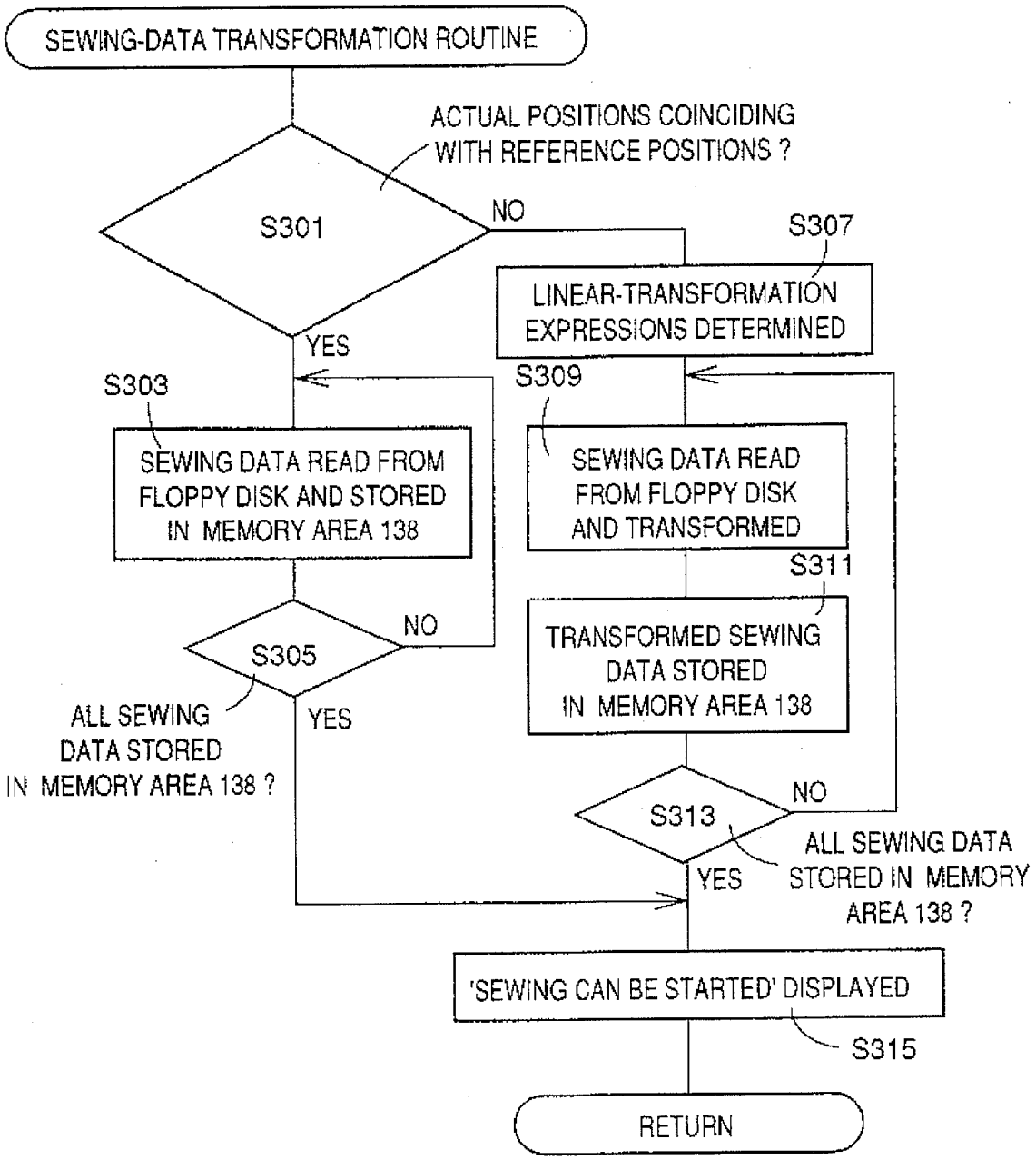
FIG. 8 is a flow chart representing a sewing-data transformation routine as one of the control programs.

Subsequently, the control of the CPU 94 proceeds with the sewing-data transformation routine of FIG. 8.

First, at Step S301, the CPU 94 judges whether the detected position of the first detection point stored in the memory area 132 substantially coincides with the reference position of the first detection point stored in the memory area 136, within a permissible range of errors, and judge whether the detected position of the second detection point stored in the memory area 134 substantially coincides with the reference position of the second detection point stored in the memory area 136, within a permissible range of errors. For example, in the case where the sewing data read from the floppy disk are the exclusive or modified sewing data which had been produced or obtained on the same sewing machine 140, a positive judgment is made at Step S301. In other cases, a negative judgment would probably be made at Step S301.

If a positive judgment is made at Step S301, the sewing data read from the floppy disk need not be modified. Thus, the control of the CPU 94 goes to Steps S303 and S305 to read all the sewing data from an appropriate memory area of the floppy disk and store the sewing data as they are, in the sewing-data memory area 138 of the RAM 98.

On the other hand, if a negative judgment is made at Step S301, the control of the CPU 94 goes to Step S307 to determine the previously-described linear-transformation expressions based on the transformation-reference-position data stored in the memory area 136 and the actual-position data of the first and second detection positions stored in the memory areas 132, 134. Step S307 is followed by Step S309 to read in each set of stitch-position data indicative of a stitch position where the needle 24 penetrates the work fabrics 170, 172 and to linear-transform each set of stitch-position data according to the determined expressions. At the following Step S311, the CPU 94 stores the transformed stitch-position data in the sewing-data memory area 138. Steps S309, S311, and S313 are repeated until all the sewing data are read, transformed, and stored.

If the non-modified or modified sewing data are entirely stored in the memory area 138 either at Steps S301 and S303 or at Steps S309, S311, and S313, then the control of the CPU 94 goes to Step S315 to display, on the display 122 of the operator's box 118, an indication informing the operator that sewing can be started. Thus, the sewing-data transformation routine of FIG. 8 is ended.

Figure 9:
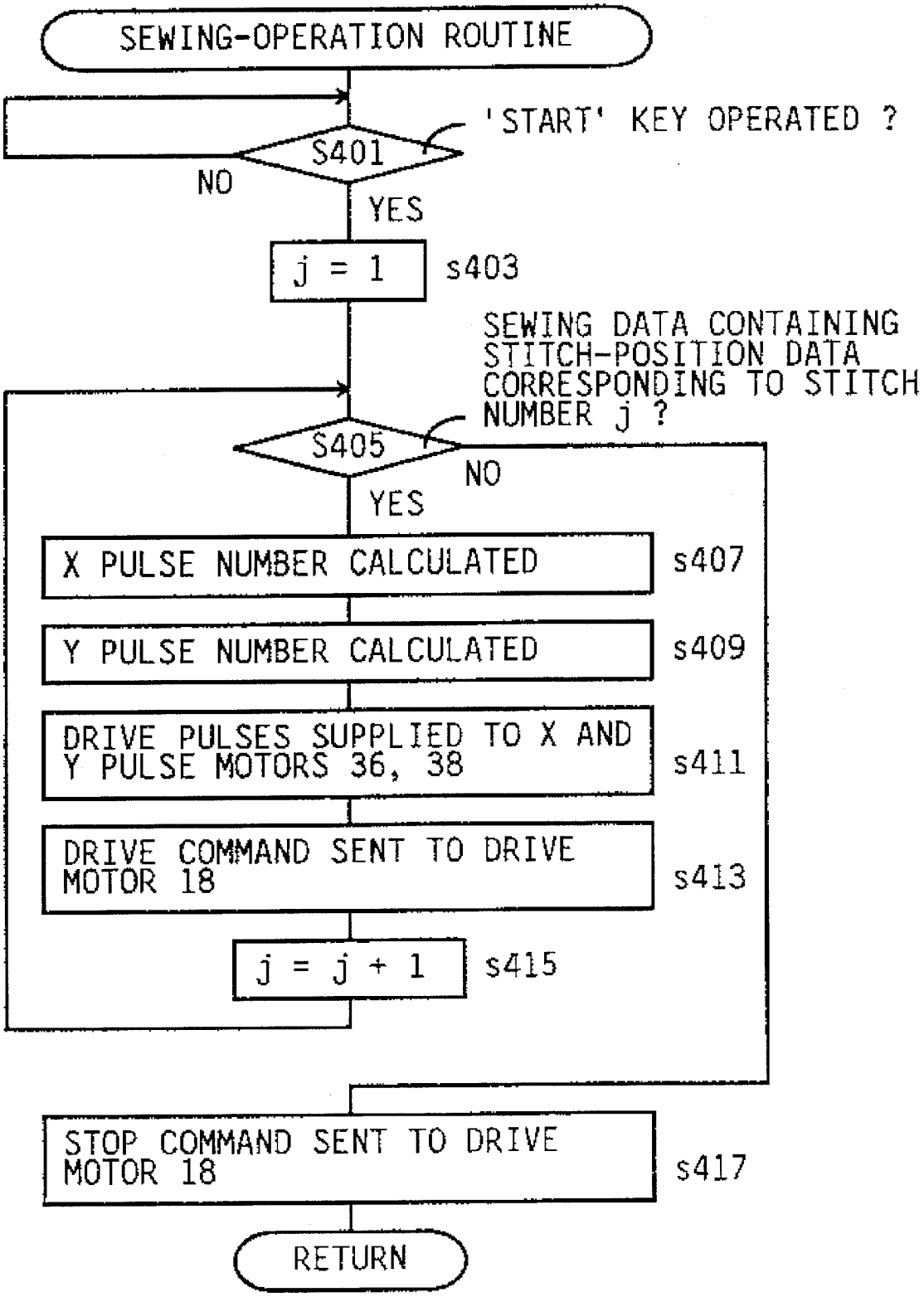
FIG. 9 is a flow chart representing a sewing-operation routine as one of the control programs.

Next, the control of the CPU 94 goes to the sewing-operation routine of FIG. 9.

Initially, at Step S401, the CPU 94 waits for the operator's pushing of the START key 120 as one of the operation keys 120 of the operator's box 118. If the operator pushes the START key 120 in response to the above-mentioned indication displayed on the display 122, the control of the CPU 94 goes to Step S403 to set a stitch-number counter, j, to j=1. Step S403 is followed by Step S405 to judge whether the sewing data stored in the memory area 138 contains a set of stitch-position data corresponding to the stitch number currently indicated by the counter j. At an early stage of a sewing operation, a positive judgment would probably be made at Step S405. In this case, the control of the CPU 94 goes to Steps S407 and the following steps. At Steps S407 and S409, the CPU 94 calculates the X-direction and Y-direction distances of the current stitch position corresponding to the current stitch number of the counter j, from the preceding stitch position, based on the sewing data stored in the memory area 138, and converts the calculated X-direction and Y-direction distances into respective numbers of pulses to be supplied to the X and Y pulse motors 36, 38, respectively, for moving the needle 24 from the preceding stitch position to the current stitch position.

At the following Step S411, the CPU 94 controls the second and third drive circuits 112, 114 to supply the respective numbers of drive pulses determined at Steps S407 and S409, to the X and Y pulse motors 36, 38, respectively, so that the workholder 30 is moved relative to the needle 24 by the distance, and in the direction, each dictated by the sewing data. At Step S413, the CPU 94 controls the first drive circuit 110 to feed a drive command to the drive motor 18, so that the stitch-forming device 148 forms, on the work fabrics 170, 172, a stitch corresponding to the current stitch number of the counter j. Step S413 is followed by Step S415 to increment the counter j by one, i.e., j←j+1.

The movement of the workholder 30, i.e., the work fabrics 170, 172 is carried out while the needle 24 is positioned away from the work fabrics 170, 172. This control is effected based on the output signal of the angular position sensor 116.

Steps S405 through S415 are repeated, so that the sewing machine 140 forms a group of stitches, i.e., a sewing pattern in accordance with the sewing data. Since each set of stitch-position data contained in the sewing data has been modified or adapted to the actual position of the work-holding plate 70 of the sewing machine 140 on which the current sewing operation is carried out, the sewing pattern is formed at an accurate position on the work fabrics 170, 172.

Meanwhile, if a negative judgment is made at Step S405, i.e., if all the sewing data are used to form a sewing pattern, the control of the CPU 94 goes to Step S417 to send a stop command to the drive motor 18.

As is apparent from the foregoing description, in the present embodiment, the first and second detection marks 154, 155 provide a plurality of detectable objects; a portion of the control device 102 for carrying out the actual-position detection routine of FIG. 6 cooperates with the needle 24 and the operator's box 118 to function as a position detector; and a portion of the control device 102 for carrying out the sewing-data transformation routine functions as data modifying means.

Additionally, a portion of the control device 102 for carrying out the transformation-reference-position-data reading-in routine cooperates with either the FDD 104 for reading in the transformation-reference-position data from the floppy disk or the operator's box 118 operable for inputting the transformation-reference-position data into the sewing machine 140, to function as a reference-position-data input device.

In each of the sewing machines 140 of the sewing system 180 shown in FIG. 11, the actual positions of the work-holding plate 70 and the position-detectable plate 150 have not been adjusted to the actual X-Y coordinate plane. However, at least one of the sewing machines 140 may be adjusted to this end. In the latter case, it is possible to produce sewing data using the thus adjusted sewing machine or machines 140 only.

Adjusting the actual positions of the work-holding plate 70 and the position-detectable plate 150 to the actual X-Y coordinate plane is carried out by adjusting at least one of (a) the workholder 30 as the work-holding device and (b) the work-displacing device 146 as the displacing device.

In the case of adjusting the workholder 30, the securing device 74, 80 for securing the work-holding plate 70 or the detectable plate 150 to the upper frame 34 may be designed in such a manner that the securing device is adjustable regarding the position thereof relative to the upper frame 34. In the latter manner, the position of the plate 70, 150 relative to the actual X-Y coordinate plane can be adjusted by correcting the position of the securing device relative to the upper frame 34.

Additionally, for the same purpose, the upper frame 34 may be designed such that the position of connection of the upper frame 34 to the lower frame 32 is changeable. By changing this connection position, the position of the upper frame 34 and work-holding plate 70 relative to the actual X-Y coordinate plane can be adjusted. Furthermore, it is possible to modify the first and second bars 40, 42 such that the position of connection of the bars 40, 42 to the lower frame 32 is changeable. In the last manner, the same effect can be obtained by changing the connection position.

Meanwhile, in the case of adjusting the work-displacing device 146, the position of attachment of the first and/or second rollers 56, 58 to the X and/or Y movable members 48, 54 may be made adjustable; or otherwise, the position of attachment of the X and/or Y movable member 48, 54 to the first and/or second racks 44, 50 may be made adjustable.

While in the illustrated embodiment the work-holding plate 70 and the position-detectable plate 150 are provided as two separate members, it is possible to provide a first and a second detectable marks 154, 155 at respective positions outside the opening 72 of the work-holding plate (a permission-range indicating mark 152 may also be provided). In the latter case, the work-holding plate 70 additionally functions as a position-detectable plate in place of the plate 150. Only if the work fabrics 170, 172 are held accurately in position by the work-holding plate 70, it is not necessary to accurately position the work- holding plate 70 relative to the upper frame 34 of the workholder 30. Detecting the respective actual positions of the first and second detectable marks 154, 155 provided on the work-holding plate 70 means detecting the errors of attachment of the work-holding plate 70 to the upper frame 34. Therefore, the positioning devices including the positioning pins 74 and holes 76 may be omitted.

Furthermore, in the case where a plurality of detectable objects are fixed to a work fabric to be sewn, it is not necessary to accurately position the work fabric relative to the work-holding device 30. In this case, however, each time a new work fabric is held by the work-holding device, it is required to detect the actual positions of the detectable objects fixed to each work fabric and modify sewing data based on the detected actual positions.

Figure 17:
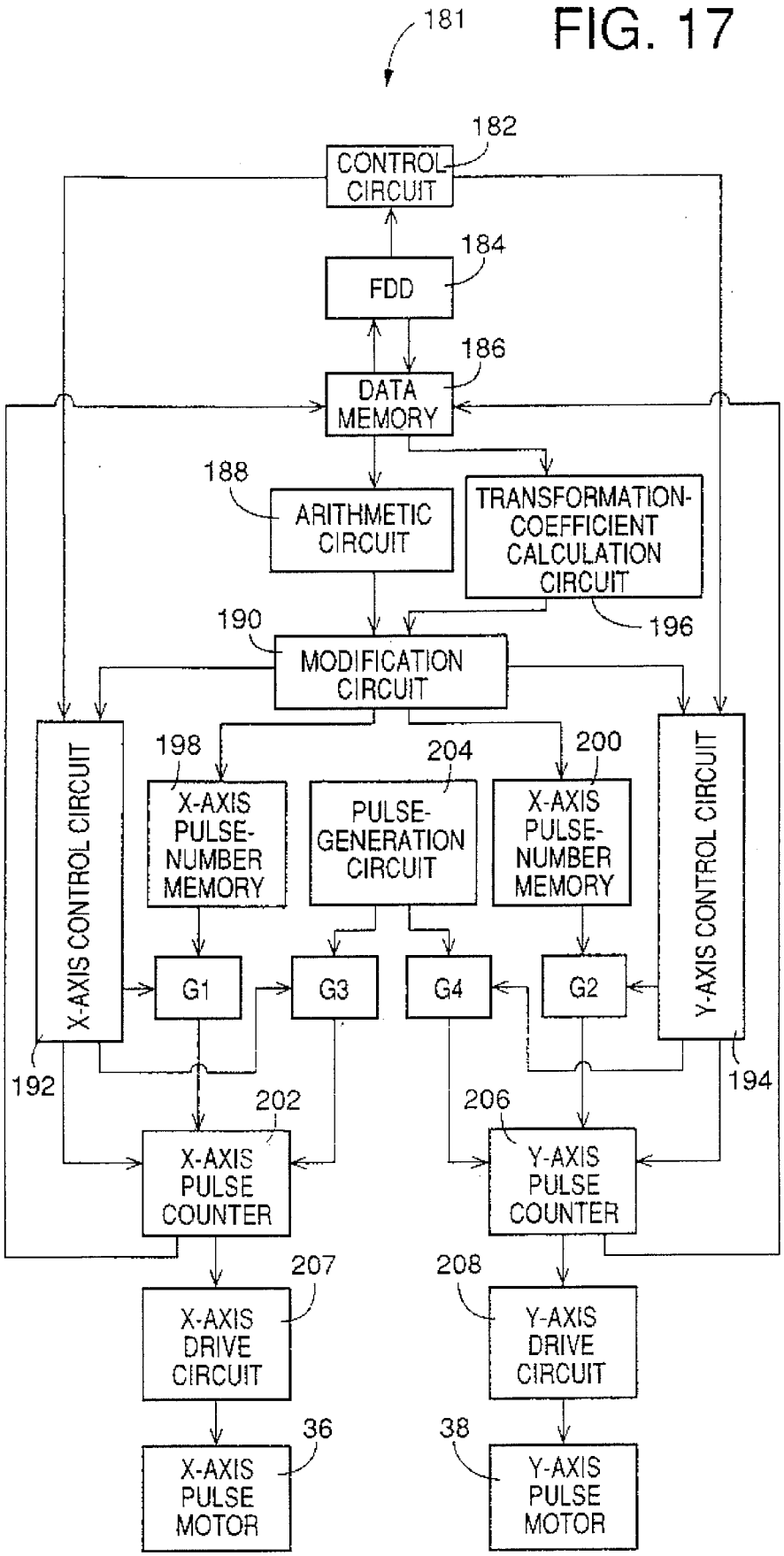
FIG. 17 is a diagrammatic view of a control device of a sewing machine including a sewing-data modifying device as a second embodiment of the present invention.

Although in the illustrated embodiment the modification of sewing data is carried out when the sewing data are read from the floppy disk being inserted in the FDD 104, it is possible to modify sewing data after not only the sewing data but also transformation-reference-position data have been obtained by a sewing machine. This manner of sewing data modification is performed on a sewing-data-modifying and sewing-operation-controlling apparatus 181 (hereinafter, referred to as the "modify/control apparatus"), shown in FIG. 17, as a second embodiment of the present invention. The same reference numerals as used in FIGS. 1–16 are used to designate the corresponding elements or parts of the second embodiment, and the description of those elements or parts is omitted.

The modify/control machine 181 has a control circuit 182 including a computer. The control circuit 182 operates for reading, from a floppy disk being inserted in an FDD 184, sewing data and transformation-reference-position data both of which relate to a sewing pattern to be formed, and storing the sewing data in a data memory 186. The data stored in the data memory 186 are separated by an arithmetic circuit 188 into (a) control information and (b) sewing data (i.e., sets of x and Y coordinates representative of stitch positions) necessary to drive a work-displacing device 146 including an X-axis and a Y-axis pulse motor 36, 38. The sewing data, given in the unit of millimeter (mm), are converted into sewing data in the numbers of drive pulses to be supplied to the X and Y pulse motors 36, 38. The control information is supplied via a modification circuit 190 to an X-axis control circuit 192 and a Y-axis control circuit 194, while the sewing data given in the pulse numbers are fed to the modification circuit 190. A transformation-coefficient calculation circuit 196 calculates the four coefficients of two linear-transformation expressions, based on the transformation-reference-position data stored in the data memory 186 and the detected actual positions of the first and second detection positions of a sewing machine 140 on which a sewing operation is to be carried out. The calculated four coefficients are sent to the modification circuit 190. The modification circuit 190 modifies, using the transformation coefficients, each of the sets of stitch-position data in terms of pulse numbers. Additionally, the modification circuit 190 calculates the differences between each pair of successive sets of stitch-position data and thereby determines respective numbers of drive pulses to be fed to the X and Y pulse motors 36, 38 to displace the needle 24 from each stitch position to the next stitch position. The thus obtained x and y pulse numbers for the stitch positions are stored in an X-axis pulse-number memory 198 and a Y-axis pulse-number memory 200, respectively.

Regarding the movement of the needle 24 in the positive or negative direction of the X axis, the X-axis control circuit 192 opens Gate, G1, at an appropriate timing according to the control information fed from the control circuit 182, so that the x pulse number for a next stitch position is transferred from the X-axis pulse-number memory 198 to an X-axis pulse counter 202. Subsequently, the X-axis control circuit 192 opens Gate, G3, so that drive pulses generated by a pulse-generation circuit 204 are fed via the X-axis pulse counter 202 to an X-axis drive circuit 207. The X-axis drive circuit 207 drives, in response to each drive pulse, the X-axis pulse motor 36 by one step. The X-axis pulse counter 202 counts the number of the drive pulses passing therethrough and, when the pulse number being counted reaches the x pulse number fed thereto via Gate G1 from the X-axis pulse-number memory 198, the X-axis control circuit 192 closes Gate G3. Thus, the X-axis pulse motor 36 is driven by an amount corresponding to each one of the great number of x pulse numbers stored in the X-axis pulse-number memory 198.

Similarly, regarding the Y axis, the Y-axis pulse motor 38 is driven by an amount corresponding to each one of a great number of x pulse numbers stored in the Y-axis pulse-number memory 200, as a result of cooperation of a Y-axis control circuit 194, Gates, G2 and G4, a Y-axis pulse counter 206, and a Y-axis drive circuit 208.

The modify/control apparatus 181 repeats the above-described operation, so that the needle 24 is sequentially moved to each of the number of stitch positions defined by the sewing data and the corresponding stitches of a sewing pattern are formed on work fabrics 170, 172.

Figure 18:
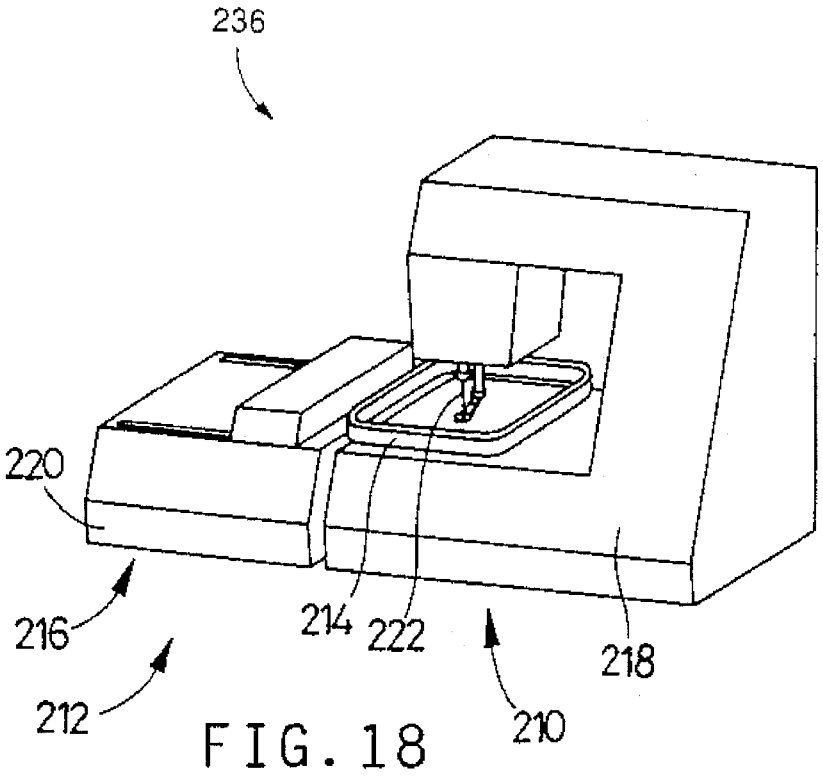
FIG. 18 is a perspective view of another sewing machine including a sewing-data modifying device as a third embodiment of the present invention.
Figure 19:
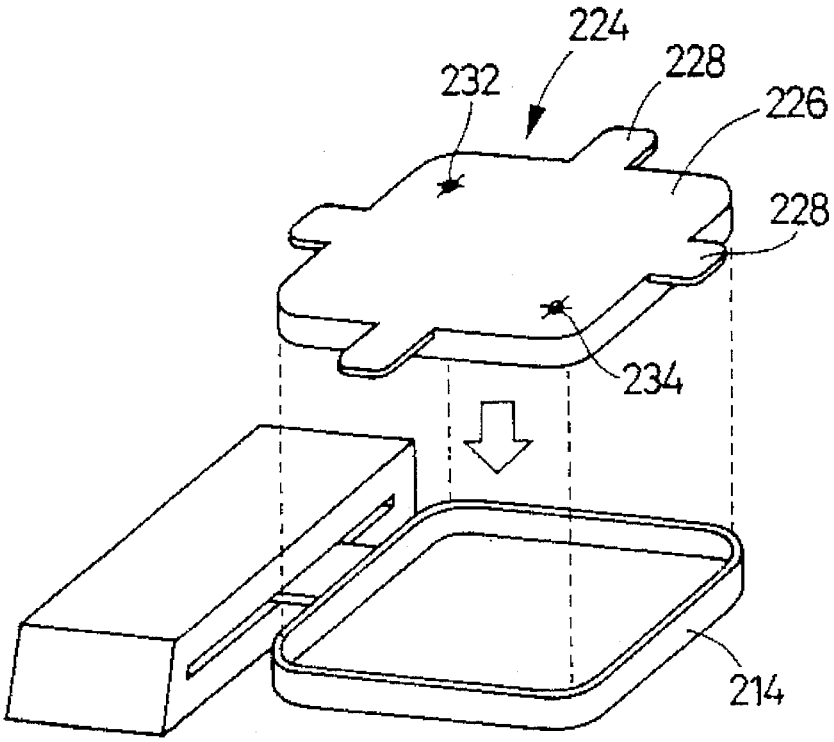
FIG. 19 is a perspective view of (a) an embroidery frame of the sewing machine of FIG. 18 and (b) a position-detectable jig member detachably fitting in the embroidery frame.

Referring next to FIGS. 18 and 19, there is shown a third embodiment of the present invention. The third embodiment relates to a sewing machine 236 of a type disclosed in Non-Examined Japanese Patent Application laid open under Publication No. 4(1992)-364888. The sewing machine 240 has a sewing device 210 and a work holding and displacing device 212 which are separate from each other. The sewing device 210 corresponds to the stitch-forming device 148 of the sewing machine 140 of FIG. 1. The work holding and displacing device 212 includes an embroidery frame 214 corresponding to the workholder 30 of the machine 140, and a work displacing device 216 corresponding to the work displacing device 146 of the machine 140.

The sewing device 210 has a first main body 218, and the work holding and displacing device 212 has a second main body 220. The first and second main bodies 218, 220 are connected to each other by a connecting device (not shown), so that the sewing machine 240 is provided.

In the present sewing machine 240, the error of positioning of the embroidery frame 214 relative to a needle 222 contains not only the machining and assembling errors of each of the sewing device 210 and the work holding and displacing device 212, but also the error of connection of the two main bodies 218, 220 to each other.

The above-explained positioning error of the embroidery frame 214 relative to the needle 222 is detected by using a position-detectable jig member 224 shown in FIG. 19, and the detected error is utilized to modify sewing data. The jig member 224 is used by being set on the embroidery frame 214. The jig member 224 includes a generally rectangular body portion 226 which just fits in the embroidery frame 214. The jig member 224 additionally includes four ear portions 228 extending laterally from the four sides of the body portion 226. With the body portion 226 being fit in the embroidery frame 214, the four ear portions 228 sit on the upper surface of the frame 214. The attaching and removing of the jig member 224 to and from the embroidery frame 214 are carried out by pinching one ear portion 228 between operator's two fingers. The jig member 224 has a first and a second detection mark 232, 234 identical with the two detectable marks 154, 155 shown in FIGS. 12 and 13. The two detection marks 232, 234 are provided in diagonally opposite two corners of the rectangular body portion 226, respectively. With the jig member 224 fitting in the embroidery frame 214, the two detection marks 232, 234 are positioned adjacent to diagonally opposite two corners of the generally rectangular frame 214, respectively.

Since the manner of modification of sewing data based on the actual positions of the two detectable marks 232, 234 (i.e., two detection points) detected using the jig member 224, is the same as that employed in the first embodiment, the description thereof is not repeated.

Figure 20:
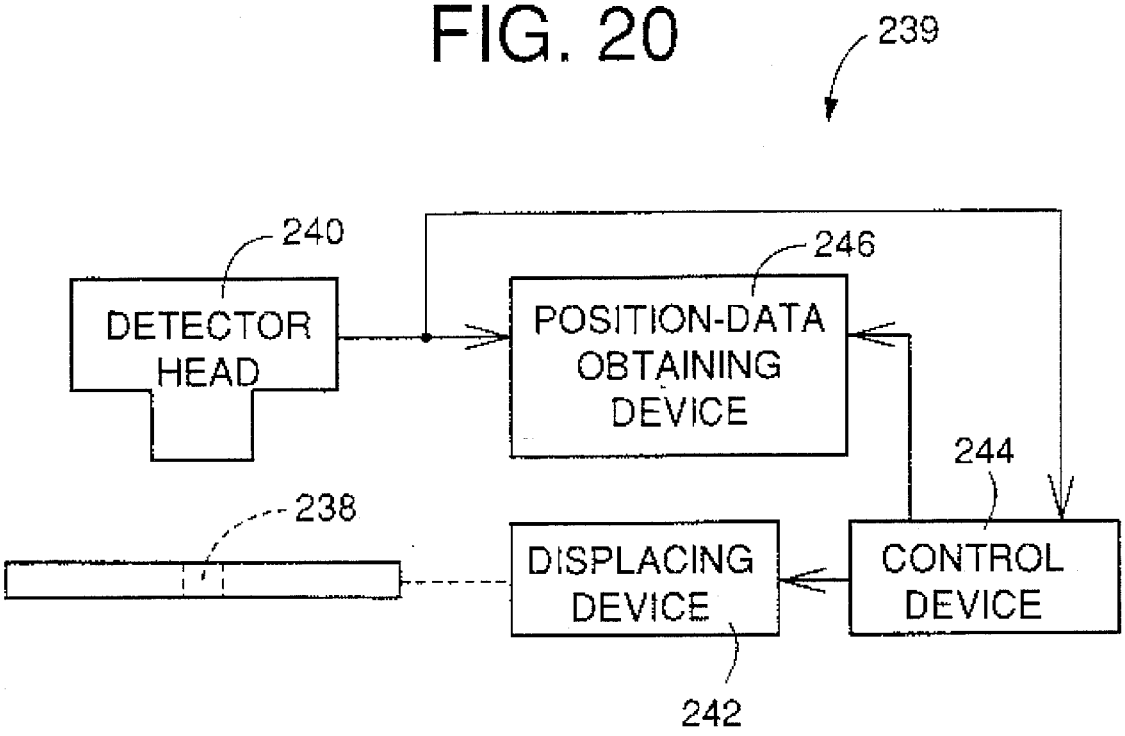
FIG. 20 is a diagrammatic view of an automatic position detecting device as part of a sewing-data modifying device embodying the present invention.
Figure 21:
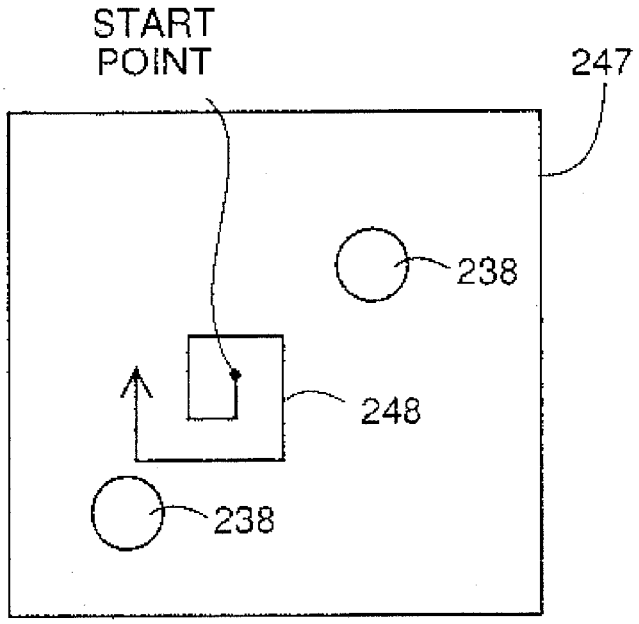
FIG. 21 is a view of an example of a prescribed path along which a detector head of the position detecting device of FIG. 20 is moved to detect a detectable object.
Figure 22:
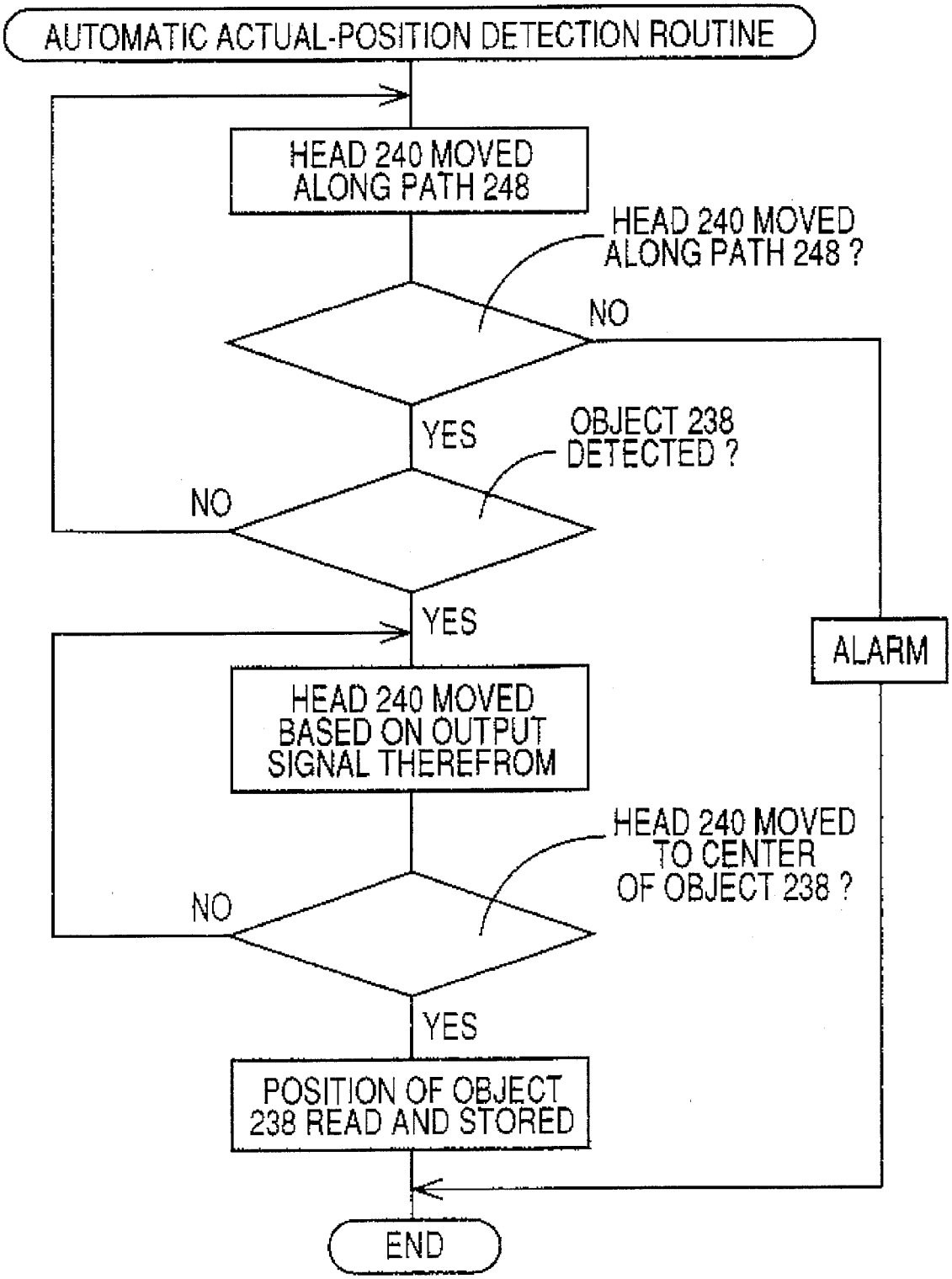
FIG. 22 is a flow chart representing a control program according to which the position detecting device of FIG. 20 is operated.
Figure 23:
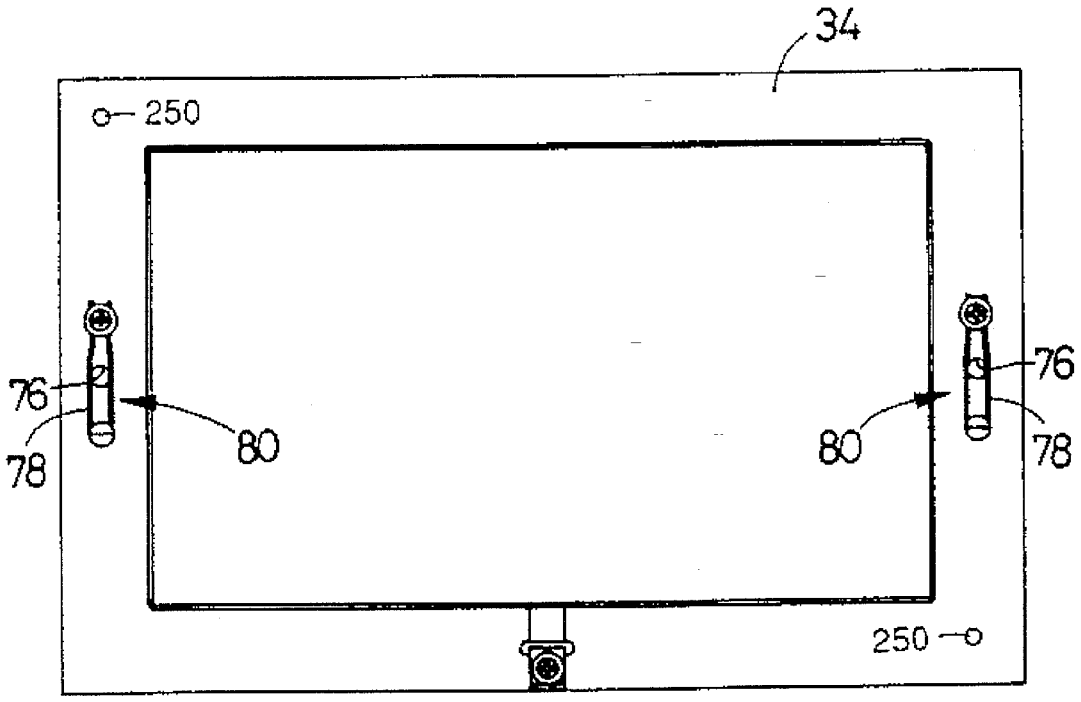
FIG. 23 is a view of detectable objects provided on a workholder as a frame holder.
Figure 24:
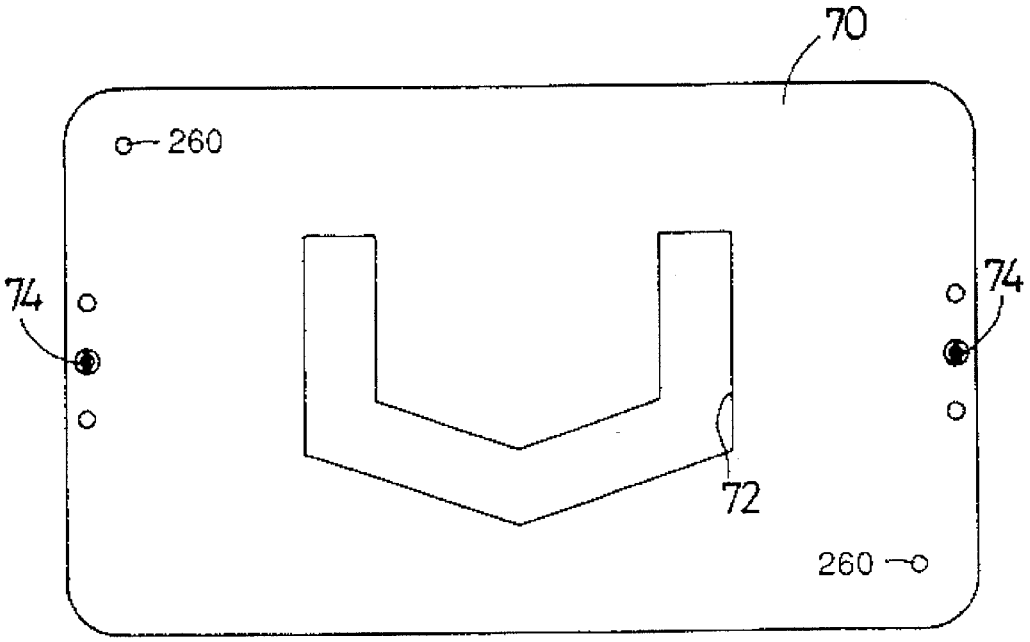
FIG. 24 is a view of detectable objects provided on a work-holding plate as a sewing frame.

In each of the first to third embodiments, the actual positions of the detection points (i.e., respective centers of the detection marks 154, 155) are detected through the operator's operation of the box 118 that is carried out while the operator views the relative position of the pointer (e.g., needle 24) to each of the detection points. However, it is possible that the sewing machine 140, 236 be provided with an automatic position detecting device 239, shown in FIG. 20, which automatically detects the respective actual positions of detectable objects 238. The detectable objects 238, 238 may be provided as (a) portions 250, 250 of the workholder 30 (or the upper frame 34), as shown in FIG. 23, (b) portions 260, 260 of the work-holding plate 70, as shown in FIG. 24, or (c) portions of the jig member 226. In either case, the detectable objects 238 have a specific physical property different from that of the remaining portion of the member 150, 70, or 226. The position detecting device 239 includes a detector head 240 which detects the specific physical property of the detectable objects 238; a displacing device 242 which displaces the detector head 240 and/or the detectable objects 238 relative to each other; a control device 244 which controls the displacing device 242 to automatically displace the head 240 and/or the objects 238; and a position-data obtaining device 246 which automatically reads the actual positions of the detectable objects 238 detected by the detector head 240 and stores the actual-position data in a memory (not shown) provided therein. The thus obtained actual-position data may be sent to the control device 102 of the sewing machine 140. Each detectable object 238 may be a portion of a member having a color, or a reflectance, different from that of a remaining portion of the same member, or otherwise may be a magnet, a heat generator, or a capacitor. The detector head 240 detects the optical, magnetic, thermal, electric, or other sort of physical property of each detectable object 238 different from that of the circumstances or environment thereof. The control device 244 controls the displacing device 242 in such a way that the displacing device 242 automatically displaces the detector head 240 relative to the detectable objects 238, along a path 248 (FIG. 21) predetermined in an area 247 within which the objects 238 can possibly exist. FIG. 21 shows the swirly path 248, for example. Additionally, the control device 244 controls, based on an output signal supplied from the detector head 240, the displacing device 242 such that, when the head 240 finds a part of each object 238, the displacing device 242 moves the head 240 to the center of that object 238. The control device 244 carries out the above operations according to the control program represented by the flow chart shown in FIG. 22.

While in each of the illustrated embodiments the sewing machine 140, 236 has the sewing-data modifying function or device provided integrally therewith, it is possible to provide a sewing-data modifying function or device separate from a sewing or stitch-forming device and connect the two devices with each other via a cable, as needed. In addition, it is possible that a sewing-data producing apparatus, independent of a sewing machine, be provided with a sewing-data modifying function or device integral therewith.

It is to be understood that the present invention may be embodied with other changes, improvements, and modifications that may occur to those skilled in the art without departing from the scope and spirit of the invention defined in the appended claims.

What is claimed is:

1. An apparatus for modifying sewing data to control a sewing machine including (a) a stitch-forming device for forming stitches on at least one work sheet, (b) a work-holding device for holding the work sheet, and (c) a displacing device for displacing at least one of the stitch-forming device and the work-holding device, relative to each other, according to the sewing data, the sewing machine having a prescribed coordinate system, the apparatus comprising:

a plurality of detectable objects located at a plurality of fixed positions spaced apart from each other on said work-holding device, respectively;

a position detector which detects an actual position of each of said detectable objects in said prescribed coordinate system of said sewing machine; and data modifying means for modifying said sewing data based on a difference of the detected actual position of said each of said detectable objects from a corresponding one of respective reference positions of the detectable objects in said prescribed coordinate system of said sewing machine.

2. An apparatus according to claim 1, wherein said work-holding device comprises a sewing frame for holding said work sheet, a frame holder for holding said sewing frame, and a positioning device for securely positioning said sewing frame relative to said frame holder, and wherein said detectable objects comprise a plurality of position-detectable portions of a jig member, each one of said sewing frame and said jig member being securely positionable relative to said frame holder in place of the other of said sewing frame and said jig member by said positioning device so that when the sewing frame is not held by the frame holder the jig member is held by the frame holder and when the jig member is not held by the frame holder the sewing frame is held by the frame holder.

3. An apparatus according to claim 1, further comprising an input device which is operable for inputting, into the apparatus, a plurality of sets of reference position data each of which is representative of a corresponding one of said reference positions of said detectable objects.

4. An apparatus according to claim 1, wherein said work-holding device comprises a sewing frame for holding said work sheet and a frame holder for holding said sewing frame, and wherein said detectable objects comprise a plurality of position-detectable portions of said sewing frame.

5. An apparatus according to claim 1, wherein said work-holding device comprises a sewing frame for holding said work sheet and a frame holder for holding said sewing frame, and wherein said detectable objects comprise a plurality of position-detectable portions of said frame holder.

6. An apparatus according to claim 5, wherein said work-holding device further comprises a positioning device for securely positioning said sewing frame relative to said frame holder.

7. An apparatus according to claim 2, wherein said jig member comprises a sewing-frame imitating frame having substantially the same dimensions as those of said sewing frame.

8. An apparatus according to claim 7, wherein said sewing frame comprises a work-holding plate having an opening formed through a thickness thereof, said opening having a shape conforming to, and surrounding, a sewing pattern consisting of stitches to be formed on said work sheet by said stitch-forming device, and wherein said sewing-frame imitating member comprises a detectable plate having substantially the same dimensions as those of said work-holding plate and including, as said detectable objects, a plurality of position-detectable portions which are located at a plurality of fixed positions spaced apart from each other, respectively, and on which a plurality of detectable marks are provided, respectively.

9. An apparatus according to claim 1, wherein said data modifying means comprises a memory which stores a plurality of sets of reference position data each of which is representative of a corresponding one of said reference positions of said detectable objects.

10. An apparatus according to claim 1, wherein said data modifying means comprises means for modifying said sewing data, by coordinate transformation, based on a distance and a direction of said detected actual position of said each of said detectable objects from said corresponding reference position thereof.

11. An apparatus according to claim 1, wherein said data modifying means comprises means for omitting the modification of said sewing data when an amount of said difference of said detected actual position of said each detectable object from said corresponding reference position thereof is smaller than a threshold value.

12. An apparatus according to claim 1, wherein said each detectable object has a specific physical property different from that of surroundings thereof, and wherein said position detector comprises a detector head which detects said specific physical property, a displacing device which automatically displaces at least one of said detector head and said detectable objects, relative to each other, and a position-data obtaining device which automatically obtains position data representative of said actual position of said each detectable object detected by said detector head.

13. A sewing system comprising a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, said each sewing machine having a prescribed coordinate system, at least one of said sewing machines including a plurality of detectable objects located at a plurality of fixed positions spaced apart from each other on the work-holding device thereof, respectively, a position detector which detects an actual position of each of said detectable objects in the prescribed coordinate system thereof, and data modifying means for modifying the sewing data therefor based on a difference of the detected actual position of said each of said detectable objects from a corresponding one of respective reference positions of the detectable objects in said prescribed coordinate system thereof.

14. A sewing system according to claim 13, wherein said work-holding device of said each sewing machine comprises a sewing frame for holding said work sheet, a frame holder for holding said sewing frame, and a positioning device for securely positioning said sewing frame relative to said frame holder, wherein said detectable objects comprise a plurality of position-detectable portions of a jig member, each one of said sewing frame and said jig member being securely positionable relative to said frame holder in place of the other of said sewing frame and said jig member by said positioning device so that when the sewing frame is not held by the frame holder the jig member is held by the frame holder and when the jig member is not held by the frame holder the sewing frame is held by the frame holder, and wherein said sewing machines comprise, in addition to said at least one sewing machine, a second sewing machine which has the sewing frame thereof located out of position by only a negligibly small amount from a reference position of said sewing frame thereof in the prescribed coordinate system thereof.

15. A sewing system comprising:

a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, said each sewing machine having a prescribed coordinate system; and a data producing device which has a first coordinate system and produces sewing data including a plurality of sets of position data representative of a plurality of positions in said first coordinate system, said each sewing machine including a data obtaining device which obtains said sewing data produced by said data producing device, a plurality of detectable objects located at a plurality of fixed positions spaced apart from each other on the work-holding device thereof, respectively, a position detector which detects an actual position of each of said detectable objects in said prescribed coordinate system thereof as a second coordinate system, and data modifying means for modifying the obtained sewing data based on a difference of the detected actual position of said each of said detectable objects from a corresponding one of respective reference positions of the detectable objects in said second coordinate system.

16. A sewing system according to claim 15, wherein said work-holding device comprises a sewing frame for holding said work sheet, a frame holder for holding said sewing frame, and a positioning device for securely positioning said sewing frame relative to said frame holder, and wherein said detectable objects comprise a plurality of position-detectable portions of a jig member, each one of said sewing frame and said jig member being securely positionable relative to said frame holder in place of the other of said sewing frame and said member by said positioning device so that when the sewing frame is not held by the frame holder the jig member is held by the frame holder and when the jig member is not held by the frame holder the sewing frame is held by the frame holder.

17. A sewing system according to claim 15, wherein said data producing device comprises a sewing machine including (a) a stitch-forming device for forming stitches on at least one work sheet, (b) a work-holding device for holding the work sheet, and (c) a displacing device for displacing at least one of the stitch-forming device and the work-holding device, relative to each other, according to sewing data.

18. A process of producing a number of identical sewing products by using a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, said each sewing machine having a prescribed coordinate system, the process comprising the steps of:

producing, using a first sewing machine the sewing data to control said first sewing machine to form a sewing pattern on the work sheet held by the work-holding device of the first sewing machine, detecting an actual position of each of a plurality of detectable objects located at a plurality of fixed positions spaced apart from each other on the work-holding device of said first sewing machine, respectively, in the prescribed coordinate system of the first sewing machine, inputting the produced sewing data into a second sewing machine, detecting an actual position of each of a plurality of detectable objects located at a plurality of fixed positions spaced apart from each other on the work-holding device of said second sewing machine, respectively, in the prescribed coordinate system of the second sewing machine, and modifying the input sewing data based on a difference of the detected actual position of said each of said detectable objects of said second sewing machine from the detected actual position of a corresponding one of the detectable objects of said first sewing machine.

19. A process of producing a number of identical sewing products by using a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, said each sewing machine having a prescribed coordinate system, the process comprising the steps of:

adjusting the work-holding device of at least one first sewing machine, so that said work-holding device of said first sewing machine is located out of position by only a negligibly small amount from a reference position thereof in the prescribed coordinate system of the first sewing machine, producing, using said first sewing machine, the sewing data to control the first sewing machine to form a sewing pattern on the work sheet held by the work-holding device of the first sewing machine, inputting the produced sewing data into at least one second sewing machine, detecting an actual position of each of a plurality of detectable objects located at a plurality of fixed positions spaced apart from each other on the work-holding device of said second sewing machine, respectively, in the prescribed coordinate system of the second sewing machine, and modifying the input sewing data based on a difference of the detected actual position of said each of said detectable objects of said second sewing machine from a corresponding one of respective reference positions of the detectable objects in said prescribed coordinate system of said second sewing machine.

20. A process of producing a number of identical sewing products by using a plurality of sewing machines each of which includes (a) a stitch-forming device for forming stitches on at least one work sheet, (b) a work-holding device for holding the work sheet, and (c) a displacing device for displacing at least one of the stitch-forming device and the work-holding device, relative to each other, according to sewing data, said each sewing machine having a prescribed coordinate system, the process comprising the steps of:

inputting prepared sewing data into said each sewing machine, detecting an actual position of each of a plurality of detectable objects located at a plurality of fixed positions spaced apart from each other on the work-holding device of said each sewing machine, respectively, in said prescribed coordinate system of said each sewing machine, and modifying the input sewing data based on a difference of the detected actual position of said each of said detectable objects of said each sewing machine from a corresponding one of respective reference positions of the detectable objects in said prescribed coordinate system of said each sewing machine.

21. An apparatus according to claim 1, wherein said work-holding device comprises a sewing frame for holding said work sheet, and wherein said detectable objects comprise a plurality of position-detectable portions of a jig member, said jig member being securely positionable relative to said sewing frame.

* * * * *